US009751706B2

(12) United States Patent
Shimizu

(10) Patent No.: US 9,751,706 B2
(45) Date of Patent: Sep. 5, 2017

(54) CONVEYANCE APPARATUS AND IMAGE RECORDING APPARATUS

(71) Applicant: BROTHER KOGYO KABUSHIKI KAISHA, Nagoya-shi, Aichi-ken (JP)

(72) Inventor: Yoshikazu Shimizu, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 23 days.

(21) Appl. No.: 14/643,273

(22) Filed: Mar. 10, 2015

(65) Prior Publication Data

US 2015/0251866 A1 Sep. 10, 2015

(30) Foreign Application Priority Data

Mar. 10, 2014 (JP) ..... 2014-046405

(51) Int. Cl.
*B65H 3/06* (2006.01)
*B65H 3/44* (2006.01)
*B65H 7/18* (2006.01)

(52) U.S. Cl.
CPC ..... *B65H 3/0684* (2013.01); *B65H 3/44* (2013.01); *B65H 7/18* (2013.01); *B65H 2403/732* (2013.01); *B65H 2407/21* (2013.01); *B65H 2511/414* (2013.01); *B65H 2511/415* (2013.01); *B65H 2515/704* (2013.01); *B65H 2515/706* (2013.01)

(58) Field of Classification Search
CPC . B65H 29/00; B65H 3/06; B65H 5/06; B65H 85/00; B65H 3/0615; B65H 3/36; B65H 5/00; B65H 2403/80; B65H 2513/10; B65H 3/0684; B65H 3/0607; B65H 2403/40; B65H 2403/422; B65H 2403/483
See application file for complete search history.

(56) References Cited

U.S. PATENT DOCUMENTS 6,485,011 B1 * 11/2002 Yen ..... B65H 3/06 271/10.03
7,431,283 B2 * 10/2008 Hsieh ..... B65H 3/063 271/10.13

(Continued)

FOREIGN PATENT DOCUMENTS

JP 2000-302260 A 10/2000
JP 2001-191607 A 7/2001

(Continued)

*Primary Examiner* — Thomas Morrison
(74) *Attorney, Agent, or Firm* — Merchant & Gould P.C.

(57) ABSTRACT

There is provided a conveyance apparatus including a drive source, a conveyance roller, a conveying gear, a switching gear being movable toward a first or second position, a switching section, a supporting section, a feeding section, a drive section, a first gear engaged with the switching gear at the first position, a second gear engaged with the switching gear at the second position, and a controller. A first load when the switching gear is at the first position is smaller than a second load when the switching gear is at the second position. The controller has a conveying mode in which the switching gear is at the second position, and after driving the drive source till the sheet reaches the conveyance roller from the supporting section, the controller drives the drive source upon letting the switching gear to be at the first position by driving the switching section.

12 Claims, 19 Drawing Sheets

(56) References Cited

U.S. PATENT DOCUMENTS

| | | | | |
|---|---|---|---|---|
| 8,028,986 | B2 * | 10/2011 | Koga | B65H 3/0669 271/10.01 |
| 8,123,211 | B2 * | 2/2012 | Akiyama | B65H 3/0669 271/117 |
| 8,366,097 | B2 * | 2/2013 | Tu | B65H 3/0669 192/48.5 |
| 2004/0124575 | A1 * | 7/2004 | Lee | B65H 3/08 271/10.01 |
| 2013/0278664 | A1 | 10/2013 | Arakane et al. | |

FOREIGN PATENT DOCUMENTS

| | | | |
|---|---|---|---|
| JP | 2008-001049 | A | 1/2008 |
| JP | 2012-001329 | A | 1/2012 |
| JP | 2013-204649 | A | 10/2013 |
| JP | 2013-227094 | A | 11/2013 |

* cited by examiner

CONVEYANCE APPARATUS AND IMAGE RECORDING APPARATUS

CROSS REFERENCE TO RELATED APPLICATION

The present application claims priority from Japanese Patent Application No. 2014-046405 filed on Mar. 10, 2014 the disclosure of which is incorporated herein by reference in its entirety.

BACKGROUND

1. Field of the Invention

The present invention relates to a conveyance apparatus which includes a feeding section to which a driving force is transmitted selectively from a drive source which drives a conveyance roller, and a drive section, and an image recording apparatus which includes the conveyance apparatus.

2. Description of the Related Art conveyance units in which units or components such as a sheet tray are attached in a main body including a conveying section configured to convey a sheet has hitherto been known. The sheet tray or the like include a drive section such as a feeding roller which is configured to convey the sheet to the conveying section. Components such as the feeding roller are driven by the driving force transmitted from a motor.

As a mechanism for transmitting the driving force from a motor to a plurality of drive sections, a switching gear that makes engage a plurality of gears transmitting the driving force to each section is provided, and a position of the switching gear is moved by a carriage etc., has been known.

SUMMARY

Due to a large number of functions that have been sought in a conveyance unit and an image recording apparatus, the number of driving components has increased. However, in order to fulfil a requirement of a low cost, it is not possible to increase the number of motors. Consequently, as aforementioned, a plurality of drive sections is driven by one motor by switching the transmission of driving force from the motor. Moreover, by providing components such as a cam and a torque limiter, transmission of a rotational drive and a sliding drive from one motor is realized.

However, in multiple drive sections, a load on a motor is also varied. From a cost point of view, it is not desirable to use a motor with a sufficiently high torque to suit the highest load. On the other hand, when a motor which is not sufficient necessarily for the high load is used, it is possible to cope with a high load for a short time. However, when a continuous driving time becomes long, and an environmental temperature is high, sometimes there is a sudden rise in a temperature of the motor. Therefore, it is necessary to stop the motor temporarily for cooling down, or otherwise there is a possibility of the motor getting burned.

The present teaching has been made in view of the abovementioned problems, and an object of the present teaching is to provide a mechanism which enables to reduce a load on a drive source in a conveyance unit in which a driving force is transmitted selectively to a feeding section and a drive section.

According to a first aspect of the present teaching, there is provided a conveyance apparatus configured to convey a sheet, including:

a drive source configured to generate a driving force;

a conveyance roller configured to rotate in a conveying direction by the driving force from the drive source;

a conveying gear provided coaxially to the conveyance roller to rotate with the conveyance roller as a unit;

a switching gear engaged with the conveying gear, the switching gear being configured to move to one of a first position and a second position with respect to the conveying gear, the second position being different from the first position in an axial direction of the conveying gear;

a switching section configured to move the switching gear to the first position and the second position;

a supporting section configured to support the sheet;

a feeding section configured to feed the sheet supported by the supporting section in a first feeding direction;

a drive section configured to be driven by the driving force from the drive source;

a first gear engaged with the switching gear in the first position, and configured to transmit the driving force to the drive section;

a second gear engaged with the switching gear in the second position, and configured to transmit the driving force to the feeding section, and a controller configured to control an operation of the drive source and the switching section, wherein a first load on the drive source for rotating the conveyance roller in the conveying direction under a condition that the switching gear is at the first position is smaller than a second load on the drive source for rotating the conveyance roller in the conveying direction under a condition the switching gear is at the second position, and the operation of the controller includes a conveying mode in which the switching gear is let to be at the second position by driving the switching section, and after driving the drive source till the sheet reaches the conveyance roller from the supporting section and is conveyed by the conveyance roller, the controller drives the drive source upon letting the switching gear to be at the first position by driving the switching section, and makes the conveyance roller convey the sheet.

Since the conveyance roller is driven by letting the switching gear to be at the first position at which the load on the drive source is smaller than a load when the switching gear is at the second position, after the sheet is conveyed by the conveyance roller by feeding the sheet supported by the supporting section, in the feeding direction, by transmitting the driving force from the drive source to the feeding section by the switching gear in the second position, the load on the drive source for conveying the sheet is reduced.

According to a second aspect of the present teaching, there is provided a conveyance apparatus configured to convey a sheet, including:

a drive source configured to generate a driving force;

a conveyance roller configured to rotate in a conveying direction by the driving force from the drive source;

a conveying gear provided coaxially to the conveyance roller to rotate with the conveyance roller as a unit;

a supporting section configured to support the sheet;

a feeding section configured to feed the sheet supported by the supporting section in a first feeding direction;

a drive section configured to be driven by the driving force from the drive source;

a switching section configured to selectively switch an operation mode of the conveyance apparatus between a first operation mode and a second operation mode, the first operation mode being a mode in which the driving force from the drive source is transmitted to the feeding section, and the second operation mode being a mode in which the driving force from the drive source is transmitted to the drive section; and a controller configured to control an operation of the drive source and the switching section, wherein a first load on the drive source for rotating the conveyance roller in the conveying direction under a condition that the switching section switches the operation mode to the first operation mode is smaller than a second load on the drive source for rotating the conveyance roller in the conveying direction under a condition the switching section switches the operation mode to the second operation mode, and the operation of the controller includes a conveying mode in which the operation mode is switched to the second operation mode to drive the drive source till the sheet reaches the conveyance roller from the supporting section and is conveyed by the conveyance roller, and then the operation mode is switched to the first operation mode to drive the drive source such that the conveyance roller conveys the sheet.

BRIEF DESCRIPTION OF THE DRAWINGS

FIG. 14A shows a state in which an contact member 117 of a moving member 64 is at a retracted position, and FIG. 14B shows a state in which the contact member 117 of the moving member 64 is at a projected position;

DETAILED DESCRIPTION OF THE EMBODIMENTS

Figure 1:
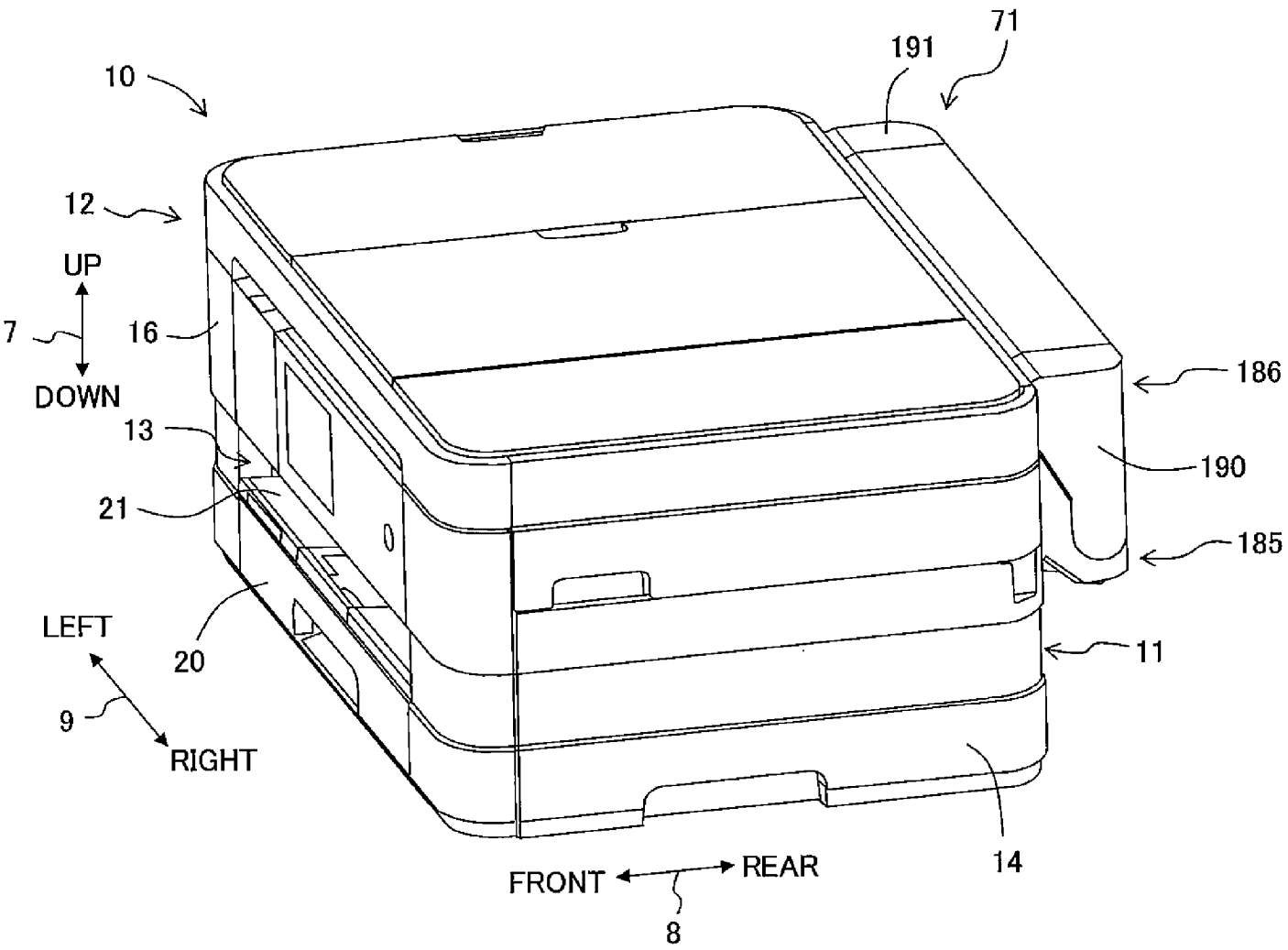
FIG. 1 is an external perspective view of a multi-function device 10 with a movable portion 186 in an erected state.

A multi-function peripheral 10 according to an embodiment of the present teaching will be described below. The embodiment described below is merely one example of the present teaching, and it is needless to mention that appropriate changes can be made in the embodiment without departing from the scope of the present teaching. Moreover, in the following description, a vertical direction 7 is defined with reference to a state in which the multi-function peripheral 10 is usably installed (state in FIG. 1), a front-rear direction 8 is defined by assuming a side on which an opening 13 is provided, to be a front side (front face), and a left-right direction 9 is defined upon viewing the multi-function peripheral 10 from the front side (front face).

[Overall Arrangement of Multi-Function Peripheral 10]

As shown in FIG. 1, the multi-function peripheral 10 is formed to be substantially rectangular parallelepiped shaped, and includes a printer section 11 which records an image on a sheet such as a recording paper by an inkjet recording method. The multi-function peripheral 10 has various functions such as a facsimile function and a print function.

The printer section 11 includes a casing 14 having the opening 13 formed in a front surface. Moreover, a discharge tray 21 and a feeding tray 20 capable of containing recording papers of various sizes are provided to be detachable from the opening 13 in the front-rear direction 8. A bottom surface 14 of the casing 14 contacts with a surface on which the multi-function peripheral 10 is placed.

Figure 2:
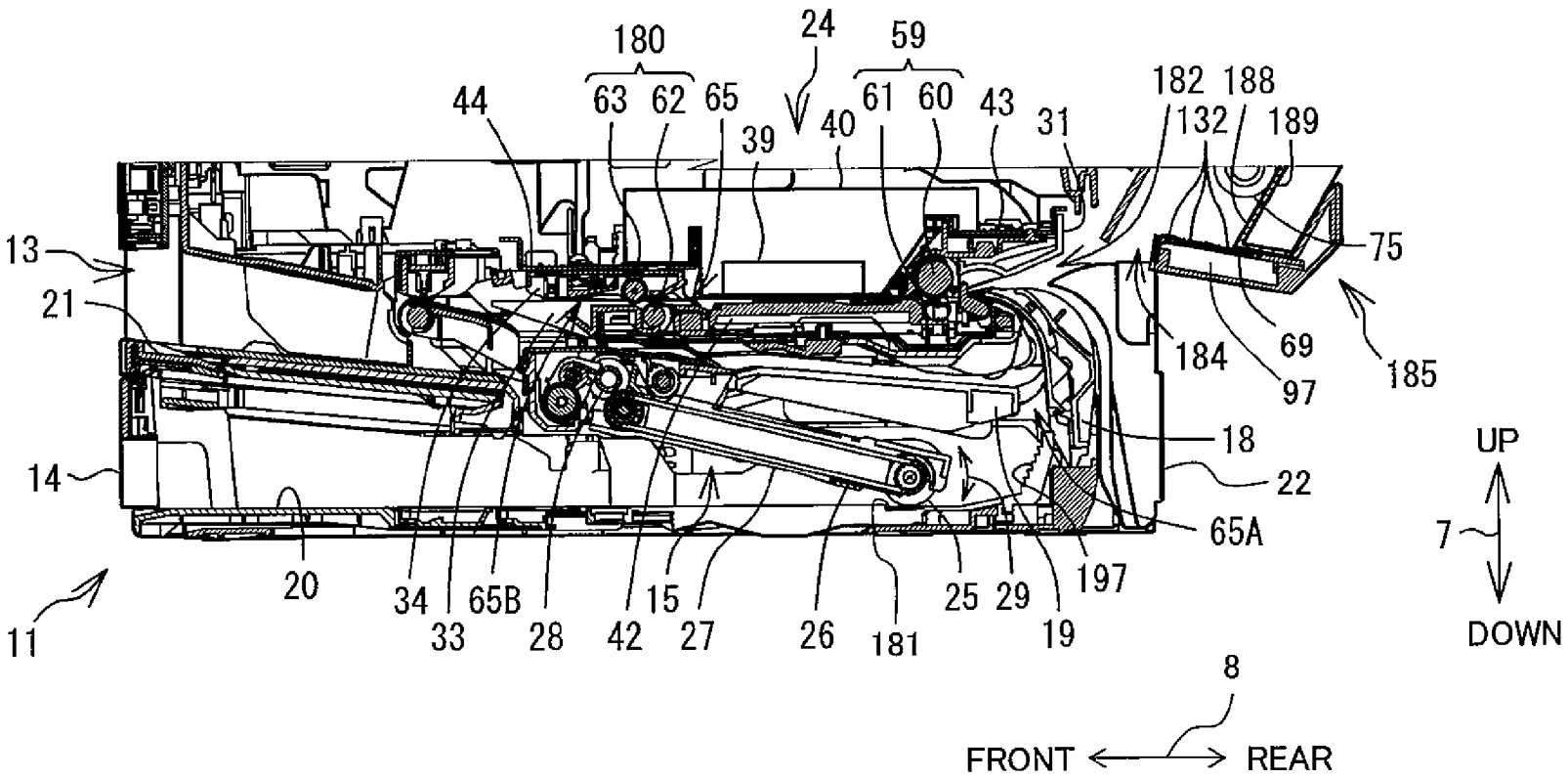
FIG. 2 is a vertical cross-sectional view showing an internal structure of a printer section 11.

As shown in FIG. 2, the printer section 11 includes a feeding section 15 which feeds a recording paper from the feeding tray 20, a recording section 24 which records an image on the recording paper, a pair of first conveyance rollers 59, and a pair of second conveyance rollers 180.

As shown in FIG. 1, a scanner section 12 is provided at an upper side of the printer section 11. A width (a length in the front-rear direction 8) and a depth (a length in the left-right direction 9) of a casing 16 of the scanner section 12 are same as a width and a depth of the casing 14 of the printer section 11. The casing 14 of the printer section 11 and the casing 16 of the scanner section 12 are integrated, and form a substantial rectangular parallelepiped shape of the multi-function peripheral 10. The scanner section 12 is a flat-bed scanner. Because a structure of the flat-bed scanner is known, description in detail thereof is omitted here. Moreover, the scanner section 12 may be provided with an automatic document feeder (ADF) which conveys upon separating a plurality of documents one-by-one.

[Printer Section 11]

A detailed structure of the printer section 11 will be described below. The printer section 11 is an example of a conveyance unit and an image recording apparatus.

[Feeding Tray 20]

The feeding tray 20 depicted in FIG. 1 and FIG. 2 has a width and a depth longer than a height (length in the vertical direction 7), and has a shape of a box with an upper surface open. The discharge tray 21 is provided at a front side of an upper surface of the feeding tray 20. The feeding tray 20 is capable of containing recording papers. The feeding tray 20 supports by a supporting surface, recording papers of various sizes, such as an A4 size to L size used for recording photographs, according to Japanese Industrial Standards. The feeding tray 20 is installed in an internal space connecting with the opening 13 in the casing 14. The feeding tray 20 is detachable from the casing 14. The feeding tray 20 is movable along the front-rear direction with respect to the casing 14 via the opening 13.

[Feeding Section 15]

As depicted in FIG. 2, the feeding section 15 includes a feeding roller 15, a feeding arm 26, a drive transmission mechanism 27, and a separating pad 181. The feeding section 15 is provided at an upper side of the feeding tray 20 and a lower side of the recording section 24. The feeding roller 25 is rotatably pivoted by a front-end portion of the feeing arm 26. The feeding arm 26 rotates in a direction of an arrow mark 29 with a pivot shaft 28 provided to a base-end portion, as a rotational center. Accordingly, the feeding roller 25 is capable of contacting with and being separated from a supporting surface of the feeding tray 20. Consequently, when the feeding tray 20 containing the recording papers is installed in the casing 14, the feeding roller 25 can contact with recording paper contained in the feeding tray 20. The separating pad 181 is provided at a position where the feeding roller 25 contacts with the supporting surface of the feeding tray 20 when the feeding tray 20 not containing any recording paper is installed in the casing 14. The separating pad 181 is formed of a material having a coefficient of friction with the recording paper larger than a coefficient of friction of the supporting surface of the feeding tray 20. For example, it is possible to form the separating pad 181 by a material such as rubber or cork.

A driving force of a motor 78 (refer to FIG. 10) is transmitted to the feeding roller 25 via a drive switching section 133 and the drive transmission mechanism 27. The drive transmission mechanism 27 transmits rotation transmitted by the pivot shaft 28 to a shaft of the feeding roller 25 by an endless belt. The feeding roller 25 rotates in a state of being contacted with a recording paper at the top of the recording papers supported by the supporting surface of the feeding tray 20. As a result, the recording paper is fed toward a conveying path 65. When the recording paper is fed toward the conveying path 65, a front end of the recording paper contacts with a separating member 197 provided at a rear side in the front-rear direction 8 of the feeding tray 20. As a result, only the recording paper at the top is separated from the recording papers below, and conveyed. A recording paper located under the top recording paper is contained in the feeding tray 20, without being dragged by the top recording paper. Although it is not depicted in the diagram, a one-way clutch is provided to the drive transmission mechanism 27. Due to the one-way clutch, one of a normal rotation and a reverse rotation of the motor 78 is transmitted to the feeding roller 25, and the remaining of the normal rotation and the reverse rotation is not transmitted to the feeding roller 25. Accordingly, it is possible to rotate a first conveyance roller 60 in a direction of feeding, without rotating the feeding roller 25.

[Conveying Path 65]

As depicted in FIG. 2, the conveying path 65 which is provided in an internal space of the casing 14 is extended to be bent so as make a U-turn upward from a rear side of the feeding tray 20. The conveying path 65 is further extended to be bent frontward from a rear side of the printer section 11. The conveying path 65 is extended almost straight toward front side and reaches the discharge tray 21. The conveying path 65 includes a curved path 65A making a U-turn, and a linear path 65B which is straight.

The curved path 65A is regulated by members such as an outer guide member 18, an inner guide member 19, and a guide member 31. The outer guide member 18 and the inner guide member 19 are arranged to face mutually leaving a space to allow the recording paper to pass through. The linear path 65B is regulated by members such as a recording section 24 and a platen 42, and a guide member 34 and a guide member 33. The recording section 24 and the platen 42 are arranged to face mutually leaving a space to allow the recording paper to pass through.

The recording paper which is fed along the conveying path 65 by the feeding roller 25 of the feeding tray 20, is conveyed to be directed upward (to an upper side) from a lower side along the curved path 65A, is further conveyed to be directed frontward from a rear side along the linear path 65B.

The outer guide member 18 defines a guiding surface of an outer side when the recording paper is conveyed along the curved path 65A. The inner guide member 19 is a guide member that defines a guiding surface of an inner side when the recording paper is conveyed along the curved path 65A. Each guiding surface may be formed by one surface or may be formed as an envelope surface of a front end of a plurality of ribs.

The guide member 31 is arranged at an upper side of the inner guide member 19 at an immediate upstream (rear side) of the pair of first conveyance rollers 59. The outer guide member 18 and the guide member 31 regulate a bypass path 182 that will be described later.

[Rear Surface Cover 22]

As depicted in FIG. 2, a rear surface cover 22 defines a part of a rear surface of the casing 14, supporting the outer guide member 18. The rear surface cover 22 is rotatably pivoted with respect to the casing 14 at both left end and right end on a lower side of the rear surface cover 22. The rear surface cover 22 is pivoted around the pivot shaft (an axis of rotation) along the left-right direction 9 such that an upper side of the rear surface cover 22 is collapsed rearward. As a result, a part of the conveying path 65 and a part of the bypass path 182 that will be described later are opened or exposed outward.

The outer guide member 18 is also rotatably pivoted with respect to the casing 14 at both left end and right end on the lower side of the outer guide member 18 similarly as the rear surface cover 22. In a state of the rear surface cover 22 pivoted to be collapsed rearward, an upper side of the outer guide member 18 is also pivotable to be collapsed rearward, around a pivot shaft (an axis of rotation) along the left-right direction 9 of a lower side of the outer guide member 18. By the outer guide member 18 being pivoted to be collapsed rearward, at least a part of the curved path 65A is opened or exposed. As depicted in FIG. 2, as the rear surface cover 22 is closed to assume an erected state, the outer guide member 18 is maintained in the erected state of being supported from the rear side by the rear surface cover 22. At this time, the guide member 18 regulates a part of the curved path 65 facing the inner guide member 19.

[Pair of First Conveyance Rollers 59 and Pair of Second Conveyance Rollers 180]

As depicted in FIG. 2, the pair of first conveyance rollers 59 is provided at an upstream side of the recording section 24 in the conveyance direction the recording paper along the conveying path 65. The pair of first conveyance rollers 59 includes a first conveyance roller 60 and a pinch roller 61. Similarly, the pair of second conveyance rollers 180 is provided at a downstream side of the recording section 24 in the conveyance direction. The pair of second conveyance rollers 180 includes a second conveyance roller 62 and a spur roller 63. The first conveyance roller 60 and the second conveyance roller 62 are rotated by rotation of the motor 78 (refer to FIG. 10) being transmitted. The first conveyance roller 60 rotates in a state of the recording paper pinched between the rollers in the pair of first conveyance rollers 59. In such manner, the pair of first conveyance rollers 59 conveys the recording paper in the conveying direction along the conveying path 65. Similar is the case for the pair of second conveyance rollers 180.

[Recording Section 24]

As depicted in FIG. 2, the recording section 24 is provided between the pair of first conveyance rollers 59 and the pair of second conveyance rollers 180. The recording section 24 includes a carriage 40 and a recording head 39. The carriage 40 is supported by guide rails 43 and 44 provided on a rear side and a front side of the platen 42. The carriage 40 is reciprocatable in the left-right direction 9 which is a main scanning direction. The guide rail 44 is provided with a known belt mechanism. The carriage 40 is connected to an endless belt of the belt mechanism. When the endless belt to which the driving force is transmitted from a carriage motor 153 is turned (refer to FIG. 17), with the turning of the belt, the carriage 40 undergoes reciprocating movement in the left-right direction 9 along the guide rails 43 and 44. The carriage 40 and the recording head 39 are arranged to face mutually and are separated by a space with the platen 42. The carriage 40, the recording head 39, and the platen 42 define a part of the linear path 65B.

The recording head 39 is installed on the carriage 40. A plurality of nozzles is formed in a lower surface of the recording head 39. An ink from an ink cartridge (not depicted in the diagram) is supplied to the recording head 39. The recording head 39 jets the ink selectively as fine ink droplets through the plurality of nozzles. When the carriage 40 moves in the left-right direction, the ink droplets are jetted from the nozzles on to the recording paper which his supported by the platen 42. An image is recorded on the recording paper by the ink droplets jetted being adhered to the recording paper on the platen 42.

[Bypass Path 182]

As depicted in FIG. 2, an opening 184 is provided at an upper side of the rear surface cover 22 on the rear surface of the casing 14. At the interior of the casing 14, the bypass path 182 extended from the opening 184 up to the pair of first conveyance rollers 59, is formed. The bypass path 182 is a path which is extended to be inclined downward from a rear side to the front side of the front-rear direction 8 at the interior of the casing 14. The bypass path 182 is defined by the guide member 31, the outer guide member 18, and the rear surface cover 22. The guide member 31 defines a guiding surface on the upper side, when the recording paper is conveyed along the bypass path 182. The outer guide member 18 and the rear surface cover 22 define a guiding surface on the lower side when the recording paper is conveyed along the bypass path 182. Both of the curved path 65A and the linear path 65B of the conveying path 65 are arranged on a lower side of the bypass path 182. The outer guide member 18 and the rear surface cover 22 are pivoted such that the upper side thereof is collapsed rearward. As a result, a part of the conveying path 65 and a part of the bypass path 182, are opened or exposed outward of the casing.

The recording paper contained in a bypass tray 71 which will be described later is guided in a direction inclined downward along the bypass path 182. The recording paper is guided along the linear path 65B of the conveying path 65, and is conveyed by the pair of first conveyance rollers 59. The recording paper is subjected to image recording by the recording section 24, and is discharged to the discharge tray 21. In such manner, the recording paper contained in the bypass tray 71 is conveyed along an almost linear path. Here, 'almost linear path' refers to a path in which a front surface and a rear surface of the recording paper are not inverted in the vertical direction.

[Feeding Unit 70]

Figure 3:
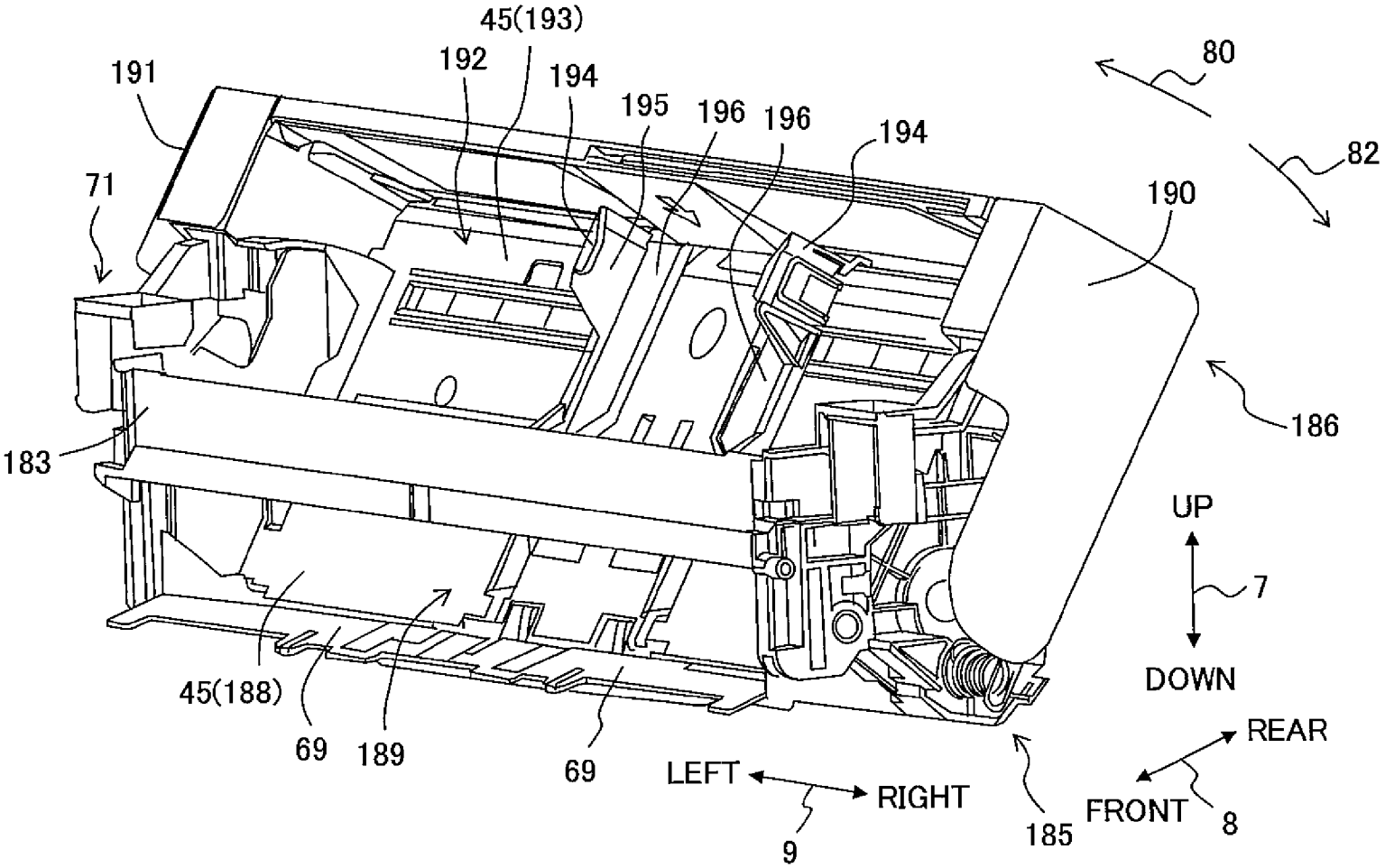
FIG. 3 is a perspective view showing a bypass tray 71 with the movable portion 186 in a collapsed state.

The printer section 11 includes a feeding unit 70. The feeding unit 70 includes the bypass tray 71 and a feeding section 72. The feeding section 72, as depicted in FIG. 3, includes a conveyance roller 75 which is an example of a feeding roller of the present teaching, a feeding arm 76 which an example of an arm of the present teaching, the motor 78 which is an example of a drive source of the present teaching, a drive transmission mechanism 79 which is an example of a drive transmission section of the present teaching, and a pivot member 30.

[Bypass Tray 71]

Figure 4:
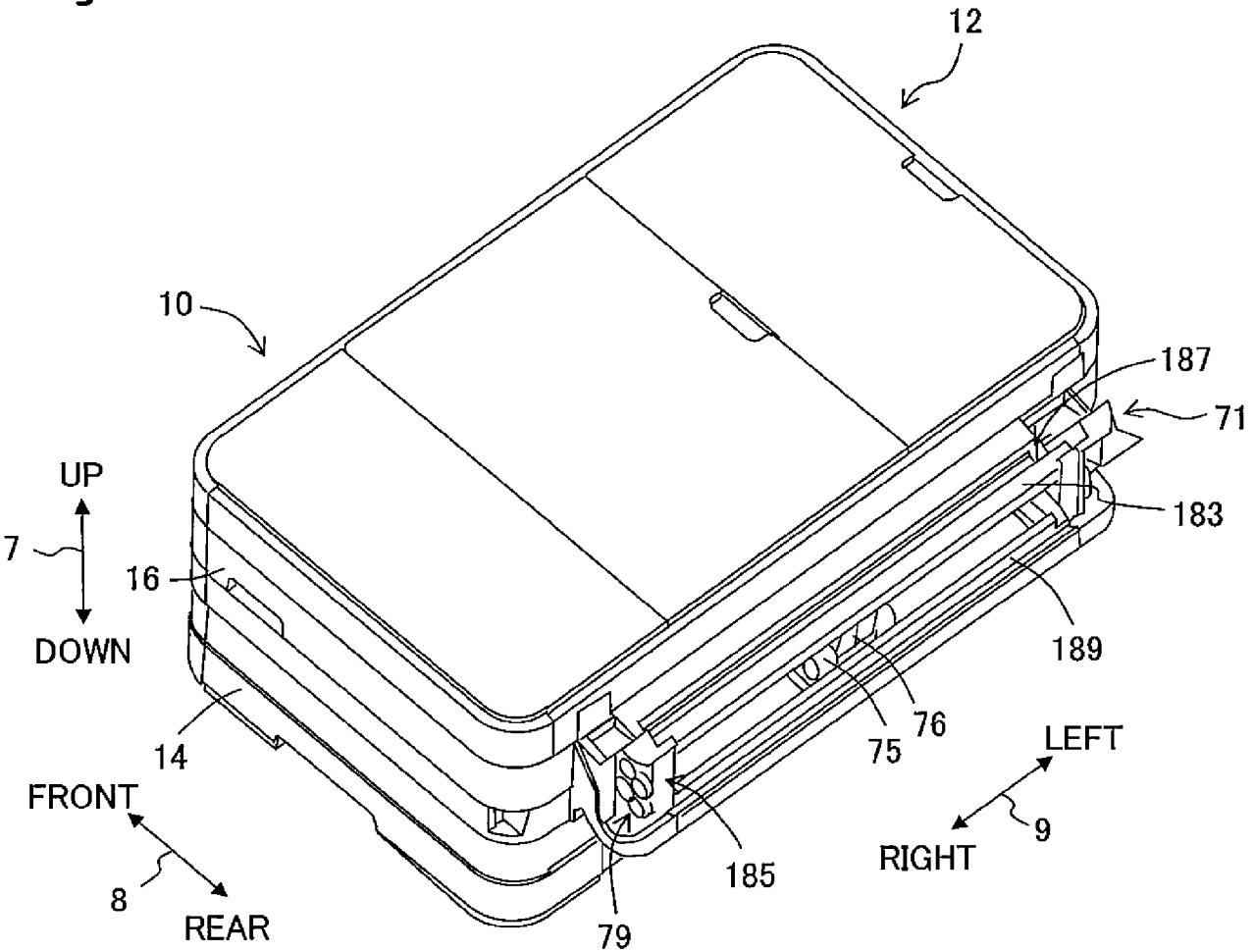
FIG. 4 is an external perspective view of a rear-surface side of the multi-function device 10 with the movable portion 186 removed.

As depicted in FIG. 1 and FIG. 4, the bypass tray 71 is provided at a rear surface side of the multi-function peripheral 10. The bypass tray 71 contains recording papers independently of the feeding tray 20.

As depicted in FIG. 1 and FIG. 4, a fixed portion 185 which is extended downward so as to cover the opening 184 (refer to FIG. 2) is provided at a rear surface side of the casing 16 of the scanner section 12. The fixed portion 185 is an example of a side wall of the present teaching. The fixed portion 185 forms a part of a downstream side of the direction of conveying of the bypass tray 71. As depicted in FIG. 4, a movable portion 185 which is pivotable in directions of arrows 80 and 82 with respect to the fixed portion 185 is provided at an upper side of the fixed portion 185. The bypass tray 71 is formed by the fixed portion 185 and the movable portion 186.

As depicted in FIG. 4, an opening 187 having a shape of a slit extended along the left-right direction 9 is formed in an upper surface of the fixed portion 185. A channel (passage) starting from the opening 187 and reaching the bypass path 182 (refer to FIG. 2) is formed in the bypass tray 71. As depicted in FIG. 3, the fixed portion 185 is provided with a supporting member 189 having a supporting surface 188. The supporting surface 188 is extended to be inclined downward up to the bypass path 182 (refer to FIG. 2). A lower end of the supporting member 189 forms a part of a guiding surface which guides the recording paper conveyed along the bypass path 182.

As depicted in FIG. 3, a reinforcing member 183 is provided at an upper-end side of the supporting member 189, and at an upper side of the supporting surface 188. The reinforcing member 183 rotatably supports a pivot shaft 66 of the feeding arm 76 (refer to FIG. 6). The pivot shaft 66 forms a part of the drive transmission mechanism 79, and rotates by rotational driving force from the motor 78 being transmitted thereto. The drive transmission mechanism 79 will be described later.

Figure 6:
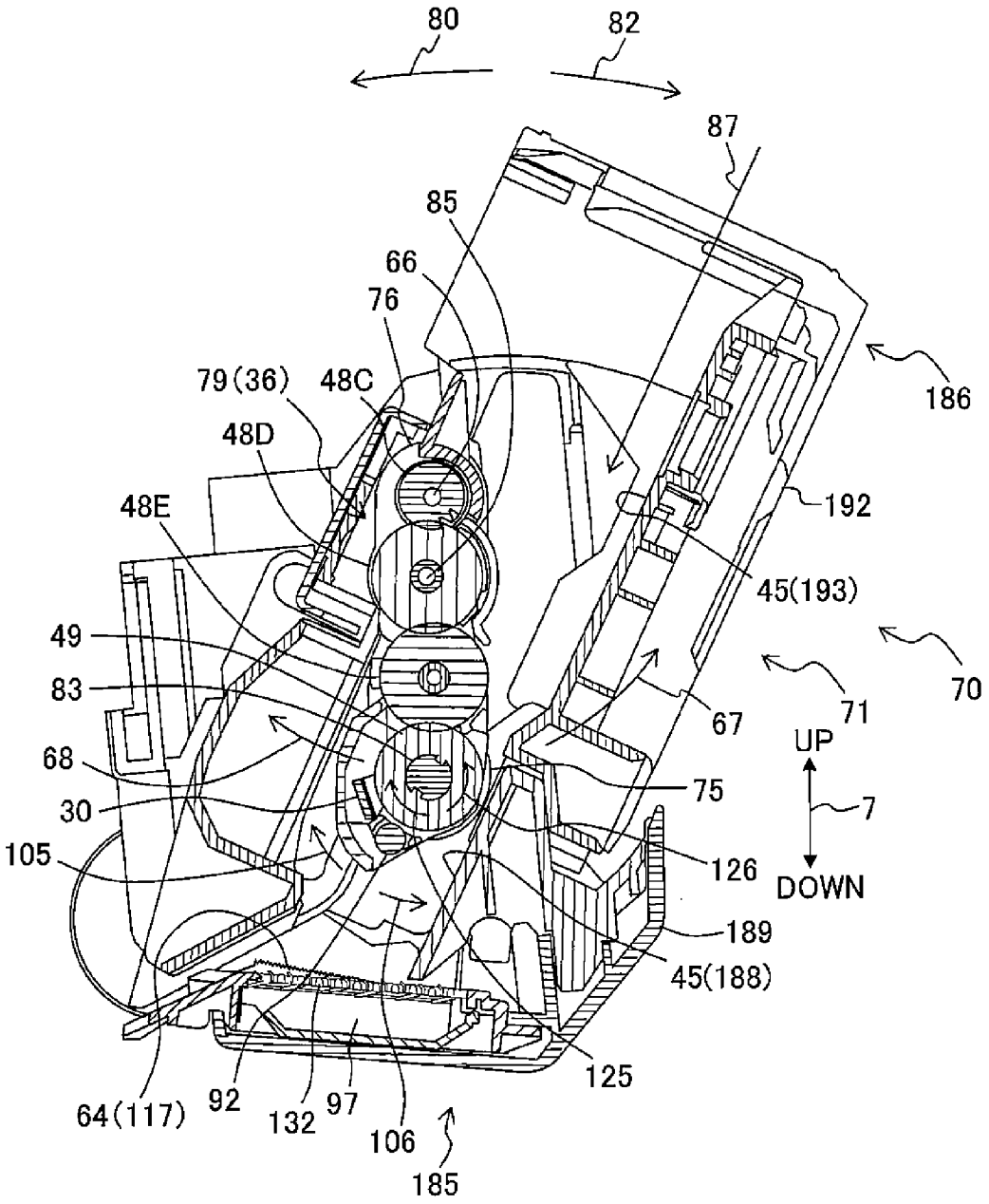
FIG. 6 is a cross-sectional view along a line VI-VI in FIG. 5.
Figure 7:
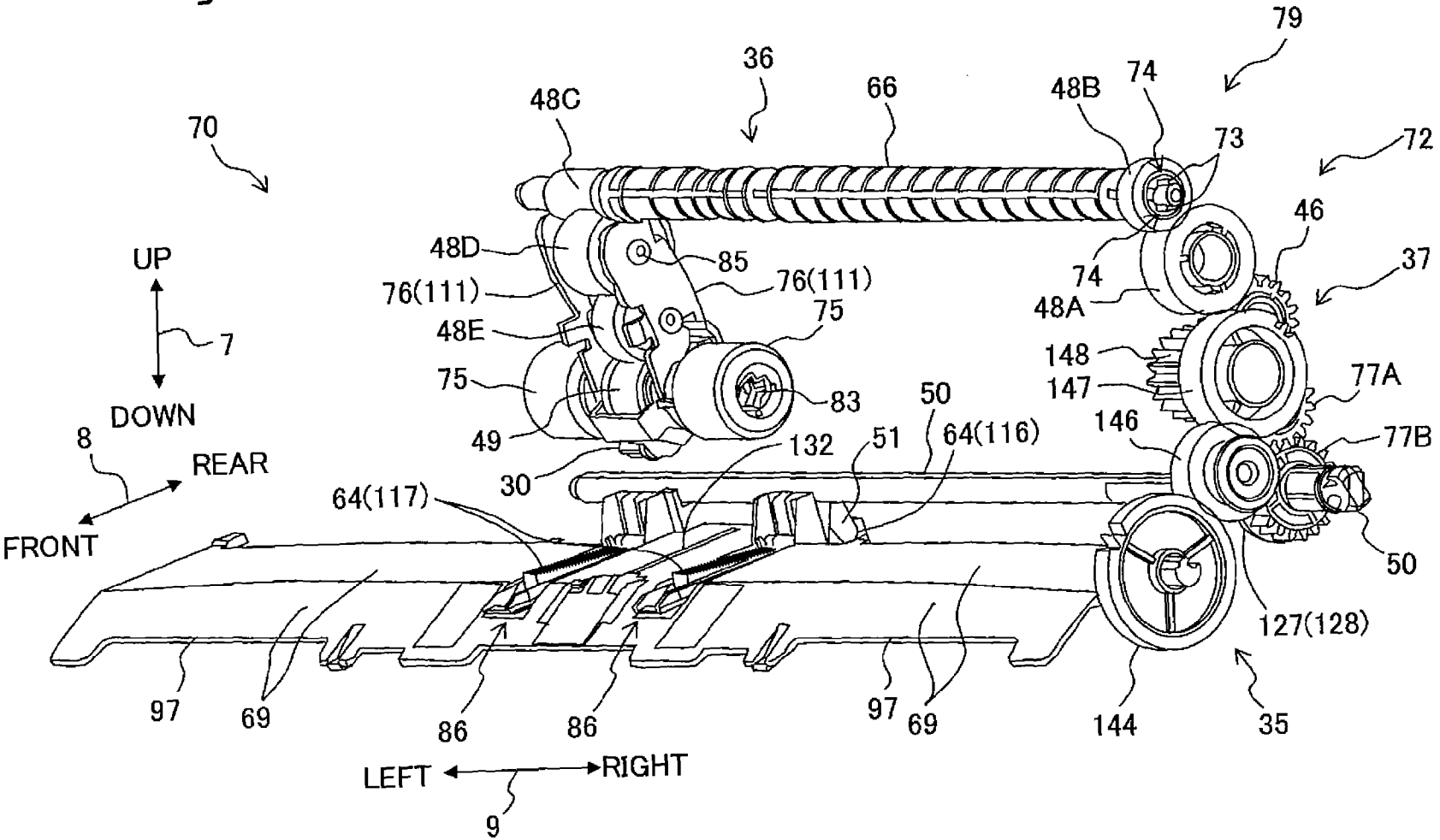
FIG. 7 is a perspective view of the feeding unit 70.

As depicted in FIG. 6 and FIG. 7, the feeding arm is pivotably supported by the pivot shaft 66. The feeding arm 76 is pivotable around the pivot shaft 66. The conveyance roller 75 is rotatably supported on front-end side of pivoting of the feeding arm 76. The feeding arm 76 is extended downward from the pivot shaft 66, and is directed toward the supporting surface 188 of the supporting member 66. The feeding arm 76 is arranged at a center in the left-right direction 9 of the fixed portion 185. An arrangement of the feeding arm 76 will be described later.

The feeding roller 75 is connected by the pivot shaft 66 and a plurality of gears 48C, 48D, 48E, and 49 (refer to FIG. 6). Rotation of the pivot shaft 66 is transmitted to the feeding roller 75 by the plurality of gears 48C, 48D, 48E, and 49, and the feeding roller 75 rotates. The feeding roller 75 rotates in a state of being contacted with a recording paper at the top of the recording papers supported by the supporting surface 188 of the bypass tray 71. As a result, the recording paper at the top is fed in a feeding direction 87 (refer to FIG. 6) along the bypass path 182 (refer to FIG. 2). A recording paper located under the top recording paper is maintained in the bypass tray 71, without being dragged by the top recording paper, upon being separated by a separating member 132 of the lower-side guide member 97 which will be described later. In such manner, the feeding section 72 which includes the feeding roller 75, the pivot shaft 66, and the feeding arm 76 is arranged in a space at an upper side of the supporting surface 188, on an outer side of the casing 14. An arrangement of the feeding roller 75 will be describe later.

As depicted in FIG. 3 and FIG. 6, the movable portion 186 is pivotably provided with respect to the fixed portion 185 at an upper side of the fixed portion 185. The movable portion 186 is pivotable between an erected state of being erected in the vertical direction 7 as depicted in FIG. 1, and a collapsed state of being inclined with respect to the vertical direction 7 as depicted in FIG. 3.

The erected state is a state for making small a space for the movable portion 186 on the rear surface side of the casing 14. In other words, the erected state is a not-in-use (nonuse) state of the bypass tray 71 (a state in which the bypass tray 71 is not in use). A rear surface of the movable portion 186 in the erected state is substantially parallel to the rear surface of the casing 14. A pivoting front end of the movable member 186 in the erected state is positioned at an upper side of a pivoting base end. The collapsed state is a state in which the supporting surface 188 and a supporting surface 193 which are inclined are let to practically one surface by inclining the movable portion 186 in a direction inclined upward toward the outer side of the casing 14. In other words, the collapsed state is a state in which the bypass tray 71 can be used. The pivoting front end of the movable portion 186 in the collapsed state is separated apart from the rear surface of the casing 14 than the pivoting base end. The user, by performing an operation, is capable of selecting arbitrarily as to whether to let the movable portion 186 to be in the erected state or in the collapsed state.

As depicted in FIG. 3, side walls 190 and 191 are provided to both sides in the left-right direction 9 of the movable portion 186. The side walls 190 and 191 cover a part of both sides in the left-right direction 9 of the fixed portion 185. The drive transmission mechanism 79 which is provided on a right side in the left-right direction 9 of the fixed portion 185 is covered by the side wall 190 of the movable portion 186.

As depicted in FIG. 3, a supporting member 192 is provided to be spread over between the side walls 190 and 191 of the movable portion 186. In the collapsed state, a supporting surface 193 provided to an upper surface of the supporting member 192 becomes practically the same flat surface as the supporting surface 188. In the bypass tray 71 in which the movable portion 186 is in the collapsed state, a flat surface 45 which is formed by the supporting surface 188 of the supporting member 189 and the supporting surface 193 of the supporting member 192 supports the recording paper. When the movable portion 186 is in the collapsed state, the supporting surface 193 is orthogonal to a surface on which the multi-function peripheral 10 is placed. In other words, the supporting surface 193 becomes parallel to the vertical direction 7 and the left-right direction 9. In the present embodiment, a surface on which the multi-function peripheral 10 is placed is a surface parallel to the left-right direction 9 and the front-rear direction 8. Here, 'practically one flat surface (same flat surface)' refers to a flat surface on which the recording paper that is supported is not bent or curled even if there is a slight level difference or unevenness between the two surfaces. In other words, 'practically one flat surface (same flat surface)' refers to 'a flat surface which supports the recording paper such that a stable separation is achieved by the separating member 132 that will be described later'. The supporting members 189 and 192 correspond to a supporting portion.

As depicted in FIG. 3, the supporting member 192 is provided with a pair of side guides 194. The pair of side guides 194 is provided to be separated apart in the left-right direction, and is projected upward from the supporting surface 193. The side guide 194 has a guide surface 195 which is extended along the feeding direction 87 of the bypass tray 71. When the recording paper is conveyed on the supporting surface 193, an end edge along the feeding direction 87 of the recording paper is guided by the guide surface 195.

The side guide 194 has a supporting surface 196 along the supporting surface 193 of the supporting member 192. The side guide 194 is substantially L-shaped, with the guide surface 195 and the supporting surface 196 orthogonal. The supporting surface 196 has a slight level difference with the supporting surface 193, but is practically on the same flat surface, and supports the recording paper together with the supporting surfaces 188 and 193. A distance by which the side guides in the pair of side guides 194 are separated apart along the left-right direction 9 is variable. Accordingly, it is possible to guide an end edge of a recording paper of various sizes supported by the supporting surfaces 193 and 196 by the guide surfaces 194 of the side guides 194.

[Feeding Roller 75 and Feeding Arm 76]

As depicted in FIG. 6, the feeding roller 75 is arranged to face the supporting surface 188 of the fixed portion 185.

As depicted in FIG. 7, a rotating shaft 83 of the feeding roller 75 is extended in the left-right direction 9. Two feeding rollers 75 are provided leaving a gap in between in the left-right direction 9. The feeding unit 70 includes the pair of feeding rollers 75. The feeding rollers in the pair of feeding rollers 75 are arranged leaving a gap in between in an axial direction of the rotating shaft 83 which is a common rotating shaft. In other words, the axial direction of the rotating shaft 83 is parallel to the left-right direction 9.

Figure 8:
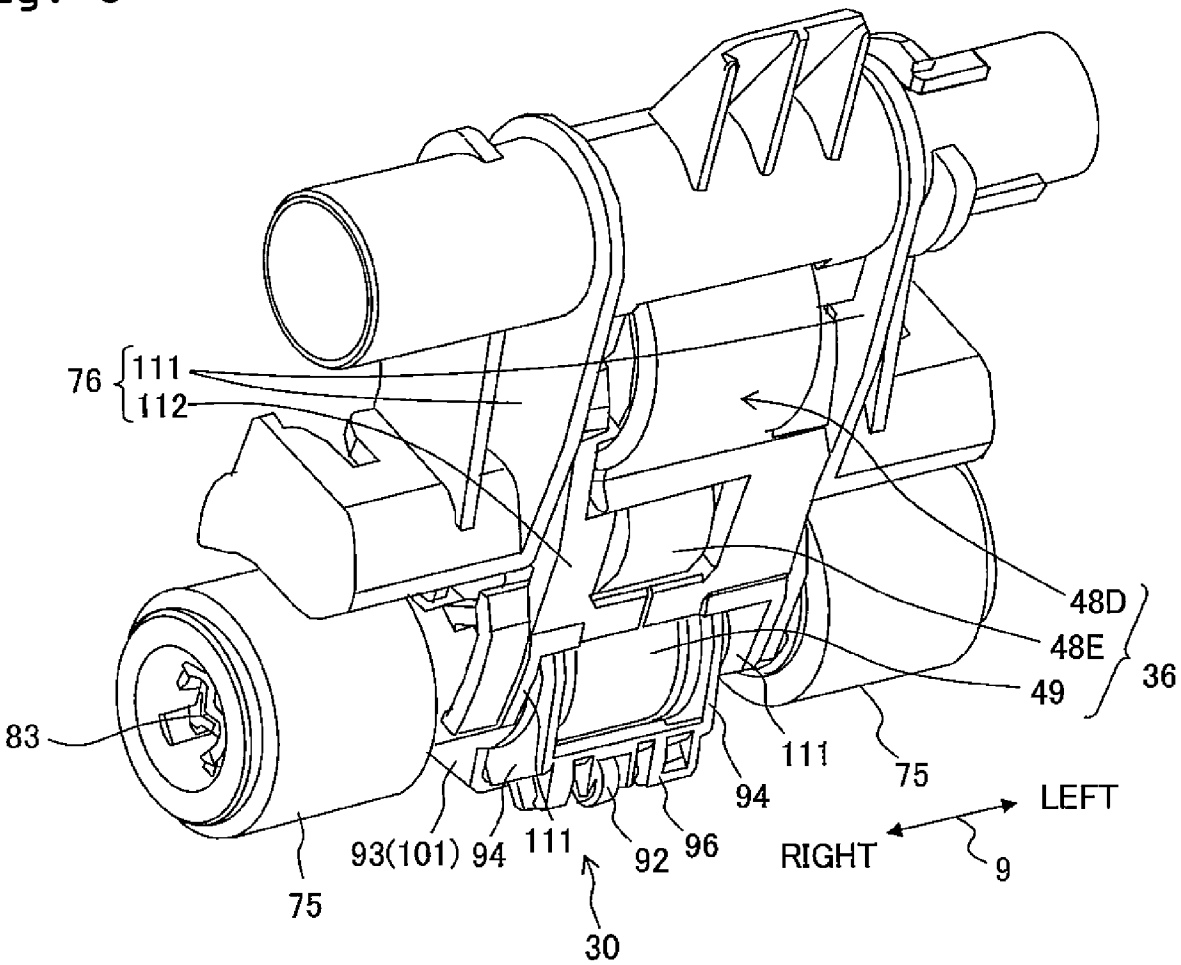
FIG. 8 is a perspective view of a surrounding portion of a feeding arm 76.

As depicted in FIG. 8, the feeding arm 76 includes a pair of side plates 111 extended from one end portion toward an upstream side of the feeding direction 87 (refer to FIG. 6), and in a direction of separating apart from the flat surface 45, and a connecting plate 112 which connects the pair of side plates 111.

The feeding roller 75 on the right side in the pair of feeding rollers 75 is rotatably supported at one end portion of the side plate 111 on the right side. The feeding roller 75 on the left side in the pair of feeding rollers 75 is rotatably supported at one end portion of the side plate 111 on the left side.

As depicted in FIG. 7, an upstream end portion in the feeding direction 87 of the pair of side plates 111, or in other words, the other end portion of the feeding arm 76 is pivotably supported by the pivot shaft 66 provided to the second drive transmission section 36. Accordingly, the feeding arm 76 is pivotable with the pivot shaft 66 as a center. In other words, the feeding arm 76 is pivotable with an end portion of the other as a pivot shaft. As a result, the feeding roller 75 can contact with and be separated apart from the flat surface 45 or from a recording paper that has been supported by the flat surface 45.

The feeding arm 76 and the pivot shaft 66 are connected by a torsion spring (not depicted in the diagram). Accordingly, a bias in a direction of an arrow 67, or toward the flat surface 45 of the bypass tray 71, is applied to the feeding arm 76 by the torsion spring as depicted in FIG. 6. An arrangement of applying the bias to the feeding arm 76 in the direction of the arrow 67 is not restricted to arrangement which includes the torsion spring. For instance, a coil spring of which one end is connected to the feeding arm 76, and the other end is connected to a frame of the printer section 11 may be arranged at a front side of the feeding arm. Even with such arrangement, a bias in the direction of arrow 67 is applied to the feeding arm 76 by the coil spring.

[Lower-Side Guide Member 97]

As depicted in FIG. 6, the lower-side guide member 97 is provided at a downstream side in the feeding direction 87, of the supporting member 189 of the bypass tray 71. An upper surface 69 of the lower-side guide member 97 is inclined with respect to the supporting surface 188 (flat surface 45). The upper surface 69 of the lower-side guide member 97 is positioned at almost same height as the opening 184 (refer to FIG. 2) in the vertical direction. The lower-side guide member 97 corresponds to a guide portion. The upper surface 69 corresponds to an contacting surface.

As feeding of a recording paper in the feeding direction 87 is started by the feeding roller 75, the lower-side guide member 97 guides a front end of the recording paper that is contacted, along the upper surface 69. The separating member 132 (refer to FIG. 6 and FIG. 7) having a plurality of teeth protruded upward from the upper surface 69 and lined up in the front-rear direction 8 is provided at a central portion in the left-right direction 9 of the upper surface 69 of the lower-side guide member 97. Front ends of the plurality of recording papers which are supported by the bypass tray 71 are separated by these teeth. Similar is the case when the front ends of the plurality of recording papers are guided along the upper surface 69 by the feeding roller 75. In other words, the separating member 132 separates a paper at the topmost position which contacts with the feeding roller 75 from the other recording papers. As a result, the feeding roller 75 feeds only the top recording paper at the topmost position toward the bypass path 182.

As depicted in FIG. 7, a pair of recesses 86 extended along the front-rear direction 8 is formed in the upper surface 69 of the lower-side guide member 97. A recess 86 is provided one each to a right side and a left side of the separating member 132, in the left-right direction 9. In other words, the separating member 132 is arranged at almost center in the left-right direction 9 of the pair of recesses 86. A moving member 64 which will be described later is arranged in the recess 86. As depicted in FIG. 14, the recess 86 is regulated by a bottom surface 84, a first side surface 122, and a second side surface 123.

[Drive Switching Section 133 and Drive Transmission Mechanism 79]

Figure 9:
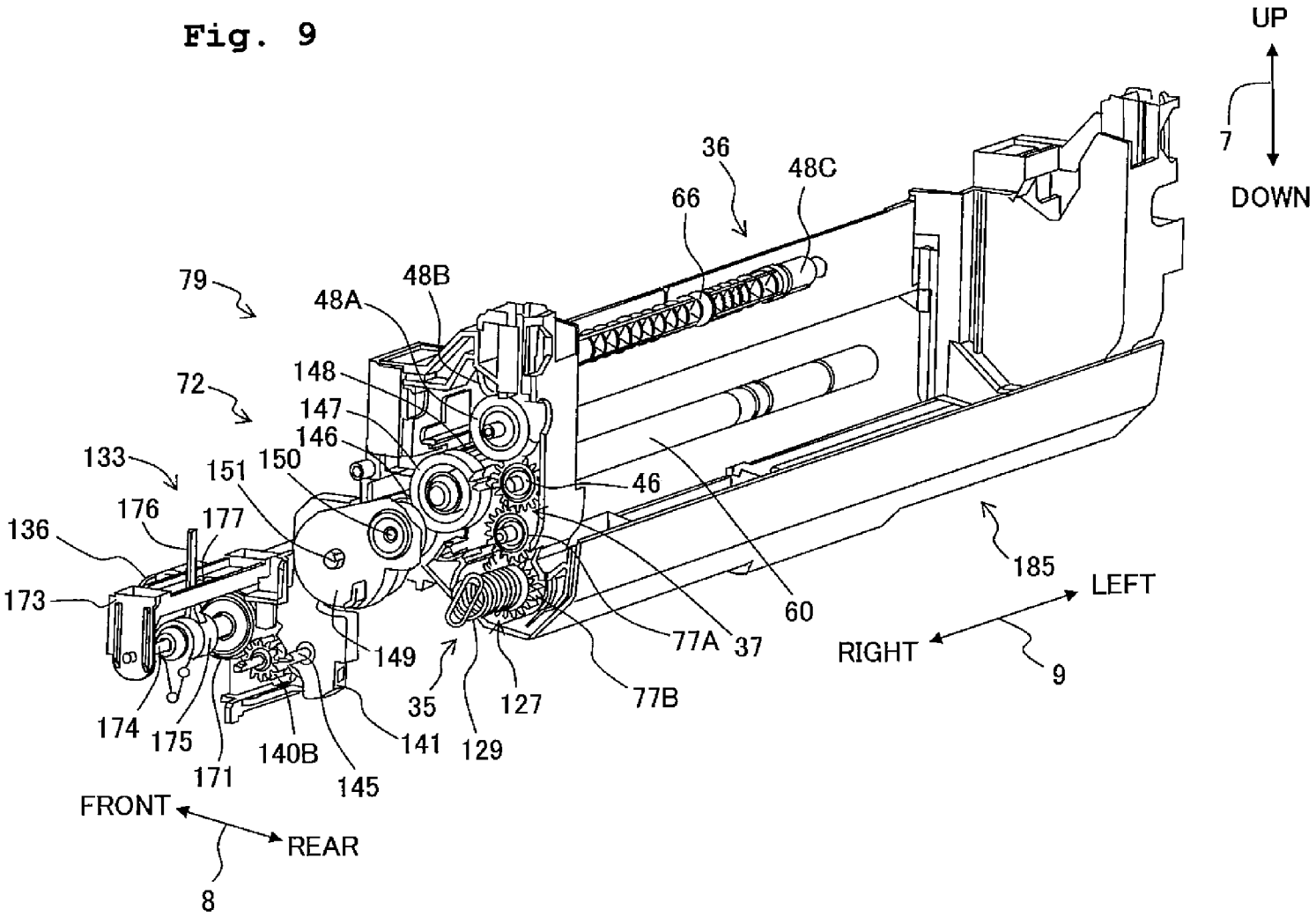
FIG. 9 is a perspective view of a surrounding portion of a drive transmission mechanism 79.
Figure 10:
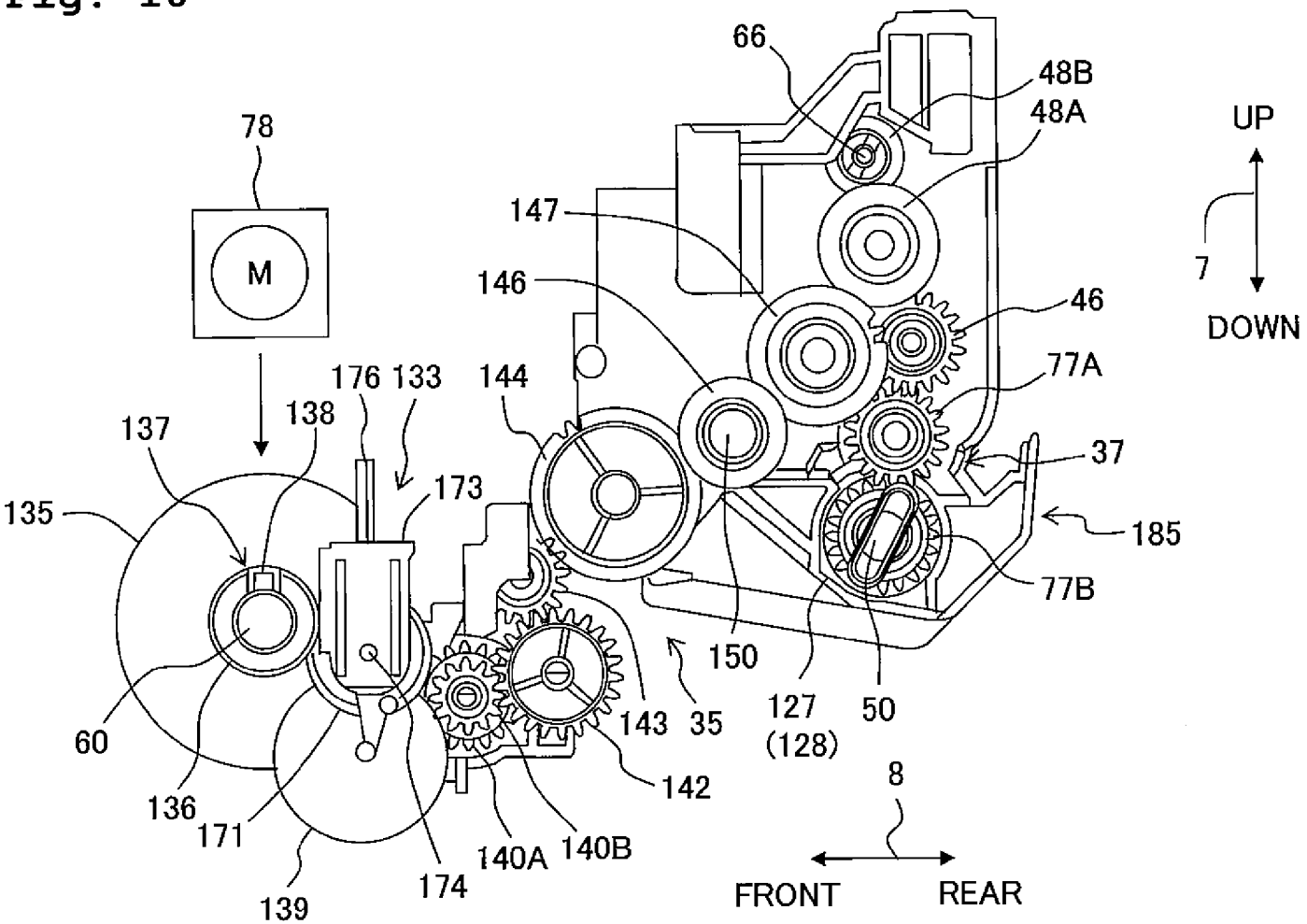
FIG. 10 is a side view of the surrounding portion of the drive transmission mechanism 79.
Figure 11:
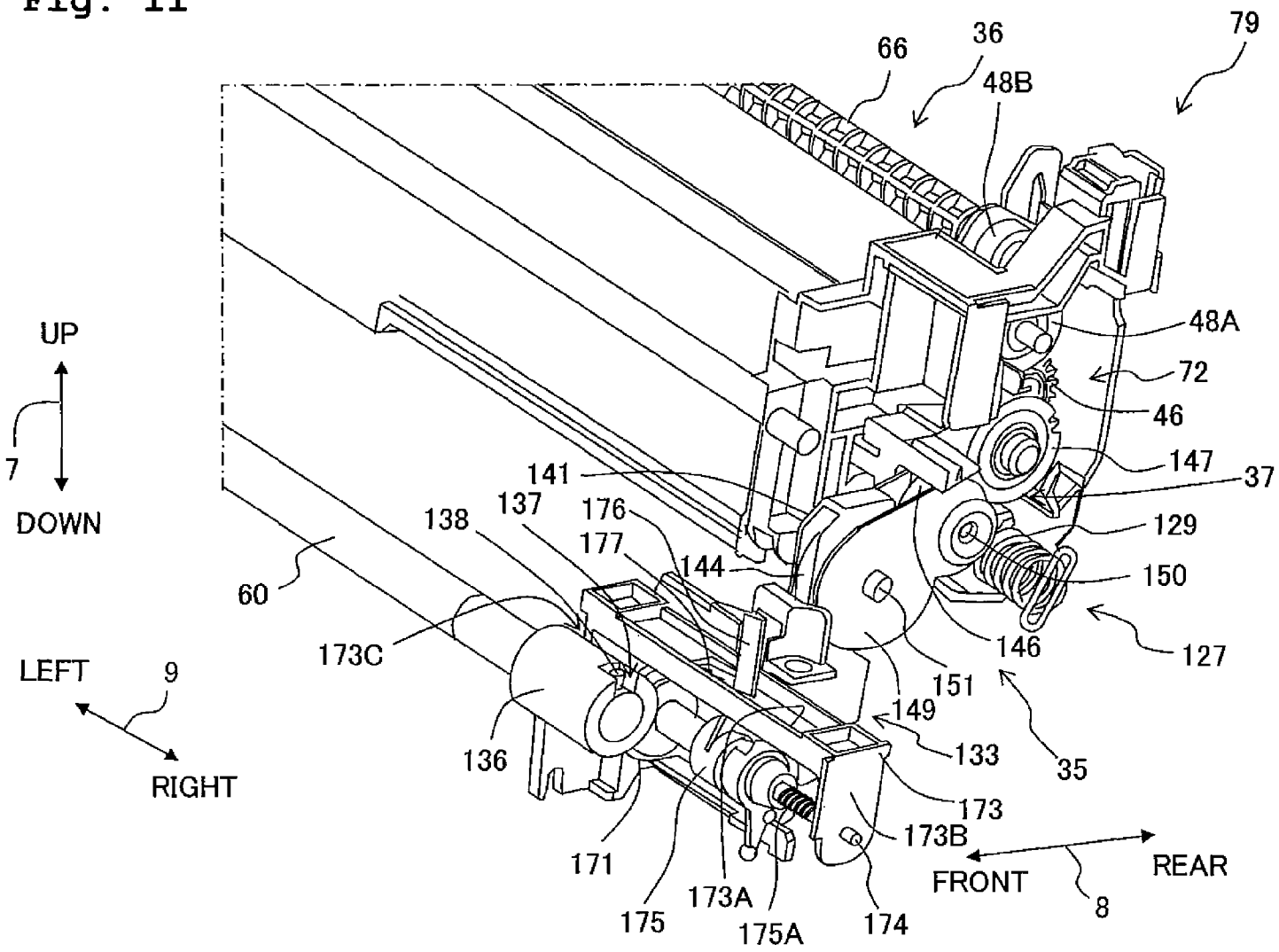
FIG. 11 is an enlarged perspective view of the surrounding area of the drive transmission mechanism 79.

As depicted in FIG. 10, the printer section 11 is provided with the motor 78 which rotates in a normal direction and a reverse direction. Moreover, as depicted in FIG. 9 and FIG. 11, the drive transmission mechanism 79 in which a plurality of gears is engaged is provided to the printer section 11. A rotational driving force which is generated by the normal rotation and the reverse rotation of the motor 79 is transmitted to the first conveyance roller 60. Furthermore, the rotational driving force generated by the motor 78 is transmitted to the feeding roller 25 or the feeding roller 75 and the moving member 64 via the drive switching section 133 and the drive transmission mechanism 79.

At the interior of the casing 14, the motor 78, the first conveyance roller 60, the drive switching section 133, and a main-body side drive transmission section 134 are provided. The casing 14 is omitted in FIG. 8, FIG. 9, and FIG. 10. Although it is not depicted in the diagrams, a rotating shaft of the motor 78 is provided with a gear, and the gear provided is engaged with a gear 135 which is provided to a left-end side of the first conveyance roller 60. The first conveyance roller 60 rotates by the rotational driving force of the motor 78 being transmitted to the gear 135.

A conveying gear 136 is provided coaxially on a right-end side of the first conveyance roller 60. A key groove 137 is formed in the conveying gear 136. A key 138 which protrudes in a radial direction from the first conveyance roller 60 is engaged in the key groove 137.

The drive switching section 133 is arranged to be movable to a first engaging position at which the drive switching section 133 transmits the driving force of the motor 78 to the feeding roller 25, but does not transmit the driving force of the motor 78 to the drive transmission mechanism 79, and a second engaging position at which the drive switching section 133 does not transmit the driving force of the motor 78 to the feeding roller 25, but transmits the driving force of the motor 78 to the drive transmission mechanism 79. The drive switching mechanism 133 is provided at a right side of the platen 42 (frontward side in FIG. 2), and to a lower side of a path of movement of the carriage 40. The drive switching mechanism 133 includes a switching gear 171 which is engaged with the conveying gear 136 driven to be rotated by the motor 78, a biasing member 175 which is installed on the same shaft on which the switching gear 171 is installed, and a holding portion 173 which holds a position of the switching gear 71.

The switching gear 171 through which a spindle 174 is inserted, is rotatable around an axis of the spindle 174, and is movable along an axial direction (or in other words, the left-right direction 9) of the spindle 174. The rotation of the motor 78 is transmitted to the switching gear 171 via the first conveyance roller 60. As depicted in FIG. 10, at a lower side of the switching gear 171, an idle gear 139 for transmitting the drive to the feeding roller 25 is supported by a shaft parallel to the spindle 174. By the switching gear 171 moving in the left-right direction 9, the idle gear 139 is engaged selectively either with the idle gear 139 or with an idle gear 140 which will be described later. The idle gear 140 transmits the driving force of the motor 78 to the moving member 64 and the feeding roller 75. The idle gear 139 corresponds to a first gear, and the idle gear 140 corresponds to a second gear. In FIG. 9 and FIG. 10, the idle gear 139 is omitted.

Figure 19:
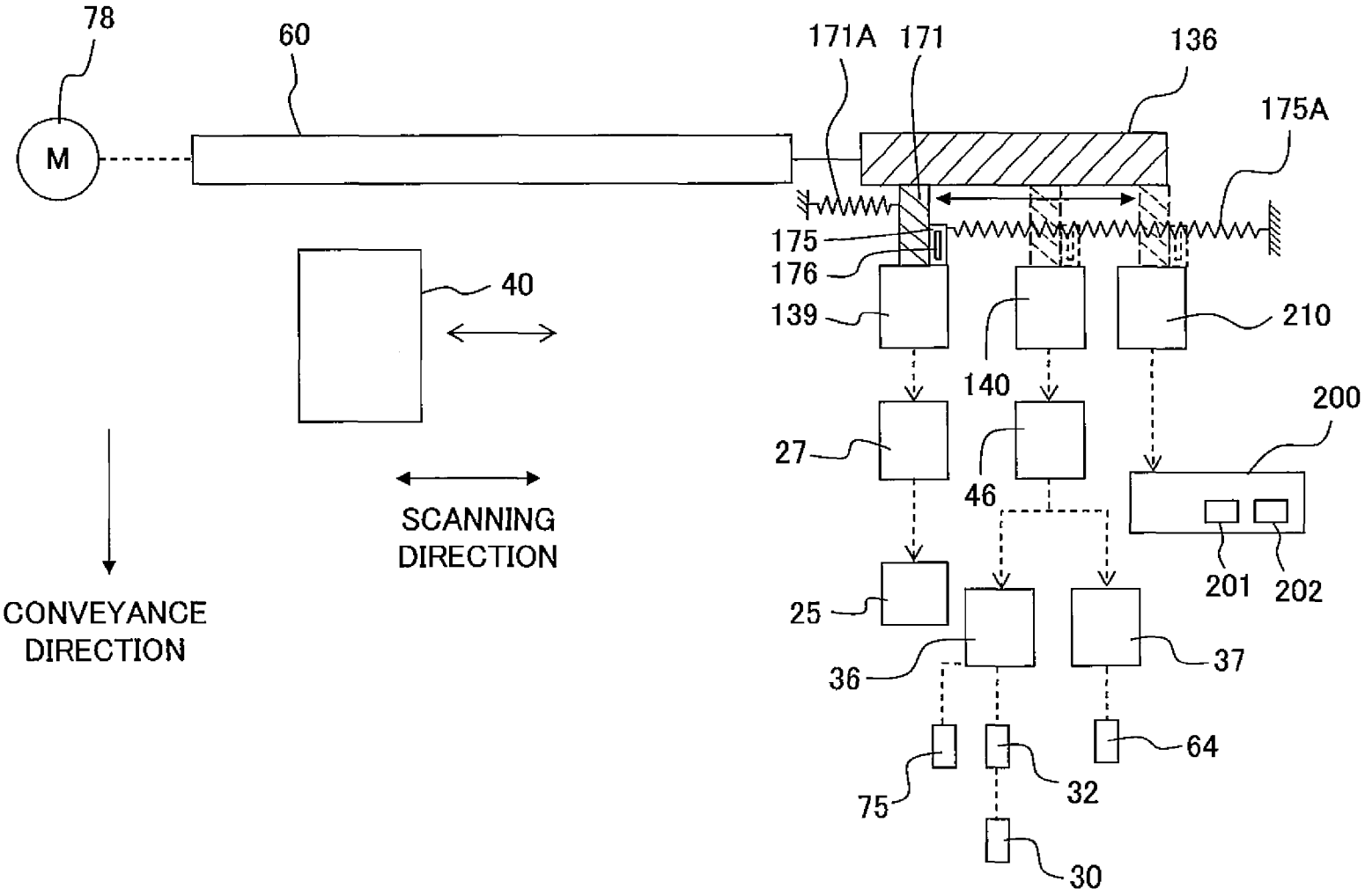
FIG. 19 is a schematic diagram showing an engaging position and a drive target of a switching gear 171.

The biasing member 175 is arranged on a right side of the switching gear 171, and the spindle 174 is inserted through the biasing member 175 such that the biasing member 175 is slidable in the left-right direction 9. A contact lever 176 is projected upward from the biasing member 175, and is extended up to the path of movement of the carriage 40 upon passing through the holding portion 173. As depicted in FIGS. 11 and 19, a bias is applied to the biasing member 175 by a first spring 175A pushing the biasing member 175 toward left side, and a bias is applied to the switching gear 171 by a second spring 171A pushing the switching member 171 toward right side. Moreover, the force imparted by the first spring 175A is stronger than the force imparted by the second spring 171A. As a result, the bias is applied to the switching gear 171 and the biasing member 175 toward the left side.

The contact lever 176 which contacts with the carriage 40 moving rightward, moves the biasing member 175 rightward, resisting the force imparted by the first spring 175A, and the biasing member 175 and the switching gear 171 are separated apart. Accordingly, the switching gear 171 moves rightward due to the force imparted by the second spring 171A and assumes the second engaging position. As a result, the switching gear 171 is engaged with the idle gear 140 as depicted in FIG. 9, FIG. 10, and FIG. 11. On the other hand, as the carriage 40 moves leftward and is separated apart from the contact lever 176, the biasing member 175 moves leftward due to the force imparted by the first spring 175A. As a result, the biasing member 175 moves the switching gear 171 leftward, resisting the force imparted by the second spring 171A. Accordingly, the switching gear 171 assumes the first engaging position, and is engaged with the idle gear 139, thereby creating a state in which transmission of drive to the feeding roller 25 is possible. The biasing member 175, the contact lever 176, the first spring 175A, and the second spring 171A correspond to a switching section.

The holding portion 173 has a hole 173A through which the contact lever 176 is inserted, and a plurality of protruding portions 177 in which the contact lever 176 can be engaged are provided to be lined up in the left-right direction 9 around the hole in the holding portion 173. The holding portion 173 includes a pair of wall portions 173B and 173C. The spindle 174 is supported by the pair of wall portions 173B and 173C. The contact lever 176, which is inserted into the holding portion 173 and moves rightward, is engaged selectively with the plurality of protruding portions 177. As a result, the contact lever 176 stops at a position of holding the switching gear 171 at the first engaging position or at a position of holding the switching gear at the second engaging position, resisting the force imparted by the second spring. By the carriage 40 being contacted from the right side, and moved rightward, the contact lever 176 can move rightward from a state of being stopped by the protruding portion 177. Moreover, by the contact lever 176 being moved to an extreme right end of the holding portion 173, the contact lever 176 is capable of moving up to the left end due to the bias being applied by the second spring, without being engaged with the protruding portion 177. In other words, the contact lever 176 moves rightward from the position (first engaging position) at the left end of the holding portion 173, and is engaged with the protruding portion 177 at the second engaging position. The contact lever 76 moves further rightward and reaches the extreme right end. Thereafter, the contact lever 176 moves up to the left end without being engaged with the protruding portion 177. The contact lever 176 undergoes such cycle of repeatedly. There may be a position other than the first engaging position and the second engaging position, at which the contact lever 176 is engaged with the protruding portion 177. For example, as it will be described later, the contact lever 176 may be engaged with the protruding portion 177 at a third engaging position which is different from the first engaging position and the second engaging position.

As depicted in FIG. 9, FIG. 10, and FIG. 11, the drive transmission mechanism 79 includes the main-body side drive transmission section 134, a first drive transmission section 35, the second drive transmission section 36, a third drive transmission section 37, and an intermediate gear 46. The main-body side drive transmission section 134 is provided at the interior of the casing 14. The first drive transmission section 35, the second drive transmission section 36, the third drive transmission section 37, and the intermediate gear 46 are provided to the fixed portion 185 of the feeding unit 70.

The idle gear 140 which is engaged with the switching gear 171 includes an idle gear 140A and a reduction gear 140B provided coaxially to the idle gear 140A. It is possible to couple the conveying gear 136 with the idle gear 140A via the switching gear 171. The reduction gear 140B is engaged with one of three gears 142, 143, 144 supported by a first gear holder 141, whichever is at the forefront position. The conveying gear 136, the switching gear 171, the idle gear 140A and the reduction gear 140B, and the gears 142, 143, and 144 form a gear train in which the gears are engaged mutually. The first gear holder 141 is rotatably supported by a spindle 145. The first gear holder 141 rotatably supports the gears 142, 143, and 144 to be sandwiched between a pair of flat plates. Although it is not depicted in the diagrams (FIG. 9, FIG. 10, and FIG. 11), the spindle 145 is supported by a member such as a frame, inside the casing 14.

The first gear holder 141 is extended upward and rearward from the spindle 145, and supports the gear 142 supported by the spindle 145, the gear 143 engaged with the gear 142, and the gear 144 engaged with the gear 143. The three gears 142, 143, and 144 supported by the first gear holder 141 rotate integrally with the pivoting of the first gear holder 141. By the gear train arranged in such manner, the main-body side drive transmission section 134 transmits the rotational driving force transmitted from the motor 78 via the first conveyance roller 60 to the gear 144.

The first drive transmission section 35 is arranged on a right side in the left-right direction 9 of the bypass tray 71 and the lower-side guide member 97. The first drive transmission section 35 includes four gears 144, 146, 147, and 148. The three gears 144, 146, and 147 form a gear train in which the gears 144, 146, and 147 are engaged mutually. The gears 147 and 148 are arranged to rotate coaxially. The gear 144 is a gear common to the main-body side drive transmission section 134 and the first drive transmission section 35.

The gears 144 and 146 are supported by a second gear holder 149. The second gear holder 149 is rotatably supported by a spindle 150. The second gear holder 149 rotatably supports the gears 144 and 146 to be sandwiched between a pair of flat plates. The spindle 150 is supported by the fixed portion 185 of the bypass tray 71. The second gear holder 149 is extended downward and frontward from the spindle 150. The spindle 150 is a spindle also for the gear 146. In FIG. 7, the second gear holder 149 is omitted.

A pivoting front end side of the first gear holder 141 and a pivoting front end side of the second gear holder 149 are connected by a connecting shaft 151. The connecting shaft 151 is rotatable with respect to the first gear holder 141 and the second gear holder 149. Consequently, the first gear holder 141 and the second gear holder 149 are capable of pivoting in a state of the connecting shaft 151 being connected without changing a distance between the spindles 145 and 149. The gear 144, by being supported by the connecting shaft 151, is supported by both the first gear holder 141 and the second gear holder 149. Consequently, a pitch of the gears 142, 143, and 144, and a pitch of the gears 144 and 146 are maintained to be fixed irrespective of a pivoting position of the first gear holder 141 and the second gear holder 149.

The gears 147 and 148 are arranged side-by-side in a direction of thrust, and rotate integrally with the same axis of rotation as a center. The gears 147 and the gear 146 are engaged. The gear 148 is engaged with the intermediate gear 46. By the gear train arranged in such manner, the first drive transmission section 35 transmits the rotational driving force that has been transmitted to the gear 144 from the motor 78, to the intermediate gear 46.

As depicted in FIG. 7, the second drive transmission section 36 includes five gears 48A, 48B, 48C, 48D, 48E, the gear 49, and the pivot shaft 66. The gears 48A and 48B are engaged mutually. The pivot shaft 66 is extended along the left-right direction 9 from a right side of the bypass tray 71 and the lower-side guide member 97 up to almost a central portion in the left-right direction 9 of the bypass tray 71 and the lower-side guide member 97. The gear 48A is engaged with the intermediate gear 46. The gear 48B which is connected to a right-end portion of the pivot shaft 66 is rotatable integrally with the pivot shaft 66, and is rotatable independently of the pivot shaft 66.

The gears 48C, 48D, and 48E form a gear train with the gears 48C, 48D, and 48E engaged mutually. The gear 48C which is arranged at one end of the gear train is installed on a left-end portion of the pivot shaft 66, and rotates integrally with the pivot shaft 66. The gear 48E which is arranged at the other end of the gear train is engaged with the gear 49. The gears 48D and 48E are rotatably supported by the feeding arm 76. In other words, the second drive transmission section 36 includes the gear train which is supported by the feeding arm 76, and in which the gears are engaged mutually. The gear 49 is installed on the rotating shaft 83 of the feeding roller 75 between the pair of feeding rollers 75, and is rotatable integrally with the rotating shaft 83 with the rotating shaft 83 as a center.

By the gear train which is arranged in such manner, the second drive transmission section 36 transmits the rotational driving force from the intermediate gear 46 to the feeding roller 75. The feeding roller 75 to which the rotational driving force of normal rotation is transmitted from the motor 78 via the second drive transmission section 36 rotates to feed the recording paper supported by the flat surface 45 of the bypass tray 71 in the feeding direction 87.

As depicted in FIG. 12, the gear 49 includes a recess 54 which is extended along the left-right direction that is an axial direction of the gear 49. The recess 54 is regulated by an inner side surface 55 of the gear 49 and a bottom surface 110 of the gear 49. A helical compression spring 114 which will be described later is arranged inside the recess 54. An opening 56 is formed in a surface facing the bottom surface 110 of the gear 49. An opening 57 having a diameter smaller than a diameter of the opening 56 is formed in the bottom surface 110 of the gear 49. The rotating shaft 83 of the feeding roller 75 is inserted through the gear 49 by passing through the openings 56 and 57.

As depicted in FIG. 7, a key 73 projected in a radial direction of the pivot shaft 66 is provided to the right-end portion of the pivot shaft 66. Moreover, a through hole through which the pivot shaft 66 is insertable is provided at a central portion of the gear 48B. Moreover, a key groove 74 which is substantially fan-shaped, and which can be fitted in the key 73 is provided at a position of the through hole corresponding to the key 73. A length of a circular arc of the key groove 74 in the circumferential direction of the gear 48B is designed to be longer than a length of the key 73 in the circumferential direction. Accordingly, if the key groove 74 does not contact with the key 73 when the gear 48B rotates, the gear 48B spins freely with respect to the pivot shaft 66. As a result, the pivot shaft 66 does not rotate till the key groove 74 contacts with the key 73. In other words, if the key 73 does not contact with the key groove 74 when the pivot shaft 66 rotates, the pivot shaft 66 spins freely with respect to the gear 48B. Therefore, the gear 48B does not rotate till the key 73 contacts with the key groove 74. If the key groove 74 contacts with the key 73 when the gear 48B rotates, and the key groove 74 pushes the key 73, the pivot shaft 66 rotates integrally with the gear 48B. In other words, if the key 73 contacts with the key groove 74 when the pivot shaft 66 rotates, and the key 73 pushes the key groove 74, the gear 48B rotates integrally with the pivot shaft 66. Accordingly, the second drive transmission 36 has a so-called play in the circumferential direction of the gear 48B in the key 73 and the key groove 74.

Inversely of what has been mentioned above, the pivot shaft 66 may be provided with the key groove 74, and the gear 48B may be provided with the key 73. Moreover, the key 73 and the key groove 74 may be provided at locations other than the pivot shaft 66 and the gear 48B in the drive transmission mechanism 79. For instance, the key 73 may be provided to a shaft 85 of the gear 48D, and the key groove 74 may be provided to the gear 48D. Or, the key 73 may be provided to a shaft of the gear 146, and the key groove 74 may be provided to the gear 146. Even in these cases, each shaft may be provided with the key groove 74, and each gear may be provided with the key 73.

As depicted in FIG. 7, the third drive transmission section 37 includes two gears 77A and 77B, a projection 51, and a pivot shaft 50 of the projection 51. The pivot shaft 50 is extended along the left-right direction 9 from a right side of the bypass tray 71 and the lower-side guide member 97, up to almost central portion in the left-right direction 9 of the bypass tray 71 and the lower-side guide member 97.

The gears 77A and 77B form a gear train in which the gears 77A and 77B are engaged mutually. The gear 77A arranged at one end of the gear train is engaged with the intermediate gear 46, and the gear 77B arranged at the other end of the gear train is connected to a right-end portion of the pivot shaft 50 via a torque limiter 127. Accordingly, the gear 77B is rotatable integrally with the pivot shaft 50, and is rotatable independently of the pivot shaft 50. The projection 51 is projected toward the moving member 64. The moving member 64 moves in a direction of rising up from the recess 86 by a slide cam which is pushed by the projection 51. By the gear train arranged in such manner, the third drive transmission section 37 transmits the rotational driving force from the intermediate gear 46 to the moving member 64.

It is needless to mention that the number of gears in the drive transmission mechanism 79 is not restricted to the number indicated in the present embodiment. Moreover, at least a part of the drive transmission mechanism 79 may be arranged by components other than gears. For instance, an arrangement may be made such that an endless belt is put around two shafts, and rotation of one shaft is transmitted to the other shaft by the belt.

As depicted in FIG. 6, the pivot member 30 turns the feeding arm 76 in directions of arrows 67 and 68 by pivoting in a direction of an arrow 105 and a direction of an arrow 106. As a result, the pivot member 30 brings the feeding roller 75 closer to the flat surface 45 of the bypass tray 71 or the recording paper which is supported by the flat surface 45. The pivot member 30 brings the feeding roller 75 separate from the flat surface 45 of the bypass tray 71 or the recording paper which is supported by the flat surface 45. As depicted in FIG. 7 and FIG. 8, the pivot member 30 is provided to one end portion of the feeding arm 76. As depicted in FIG. 1, the pivot member 30 includes a pivot body 91, a roller 92, and a pinching member 93.

The pivot body 91 includes a pair of side plates 94, a connecting plate 95 which joins a part each of the pair of side plates 94, and a projection 96 which is projected from the connecting plate 95. A material of the pivot body 91, for example, is a resin such as POM (polyacetal or polyoxymethylene).

As depicted in FIG. 8, the side plate 94 on the right side is arranged between the side plate 111 on a right side of the feeding arm 76 and the gear 49. The side plate 94 on the left side is arranged between the side plate on a left side of the feeding arm 76 and the gear 49. Here, the feeding roller 75 is arranged one each on the right of the side plate on the right side, and on the left of the side plate 11 on the left side. In other words, the side plate 94 on the left side in the left-right direction 9 is arranged between the gear 49 and the feeding roller 75 on the left side, and the side plate 94 on the right side in the left-right direction 9 is arranged between the gear 49 and the feeding roller 75 on the right side. The side plate 111 on the left side in the left-right direction 9 is arranged between the side plate 94 on the left side and the feeding roller 75 on the left side, and the side plate 111 on the right side in the left-right direction 9 is arranged between the side plate 94 on the right side and the feeding roller 75 on the right side.

Figure 12B:
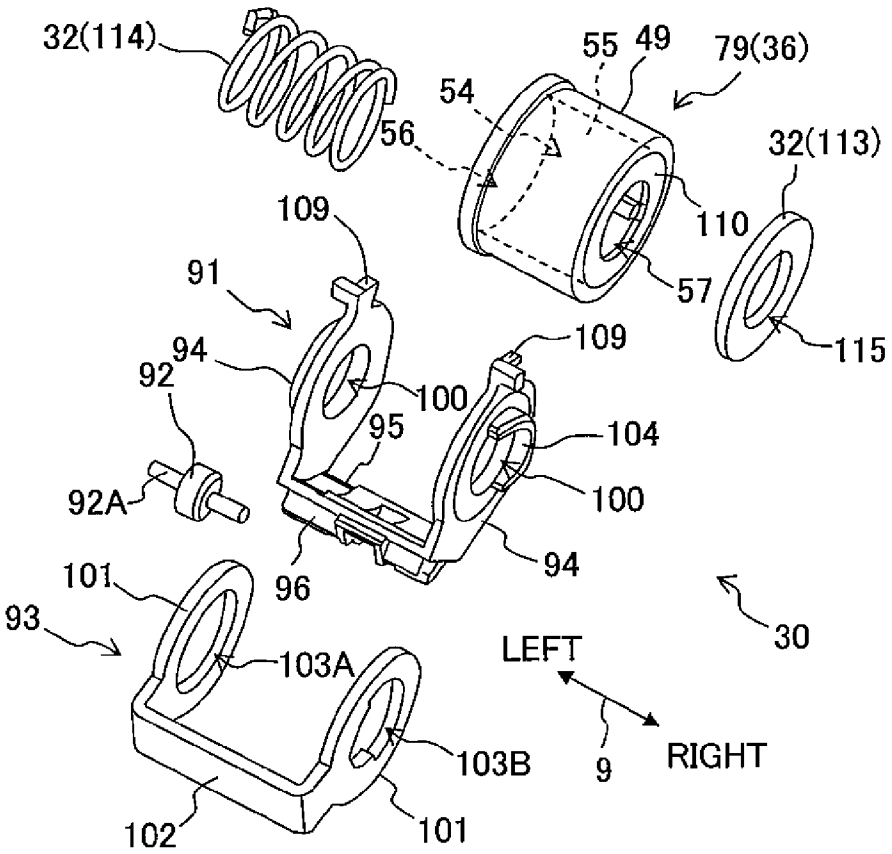
FIG. 12B is an exploded perspective view of FIG. 12A.

As depicted in FIG. 12B, an opening 100 is provided at a central portion of each side plate 94 in the pair of side plates 94. The rotating shaft 83 of the feeding roller 75 is inserted through the opening 100. By such arrangement, the pivot body 91 which includes the pair of side plates 94, the connecting plate 95, and the projection 96 is capable of pivoting with the rotating shaft 83 of the feeding roller 75 as a center.

As depicted in FIG. 12B, the projection 96 is projected from the connecting plate 95 in a direction of separating from an outer peripheral surface of the gear 49. In other words, the projection 96 is projected from the connecting plate 95 toward an outer side in a radial direction of the gear 49.

Figure 12A:
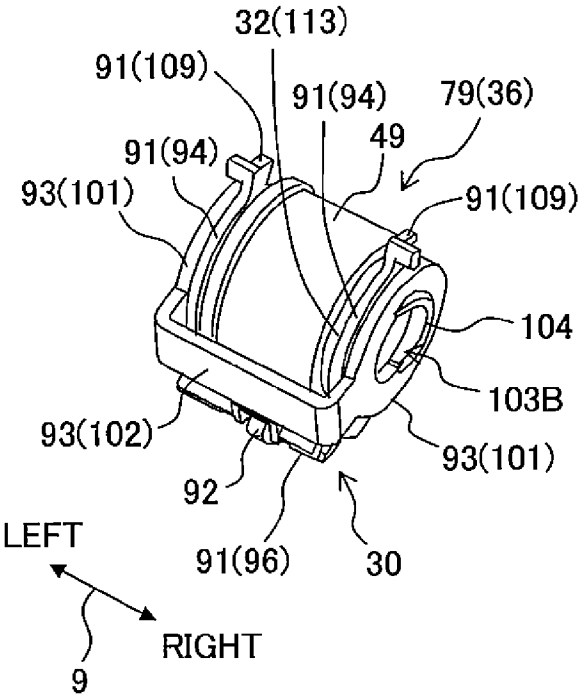
FIG. 12A is a perspective view of a pivot member 30 and a gear 49.

As depicted in FIG. 12A, the roller 92 is provided to the projection 96, or in other words, to a pivoting front end of the pivot member 30. The roller 92 is rotatably supported by the projection 96 with a rotating shaft 92A (refer to FIG. 12B) as a center of rotation. The rotating shaft 92A is extended in a direction same as the direction of the rotation of the shaft 83 of the feeding roller 75 (left-right direction 9). In a state of the roller 92 supported by the projection 96, a part of a peripheral surface of the roller 92 is projected toward an outer side in a radial direction of the gear 49.

Figure 13:
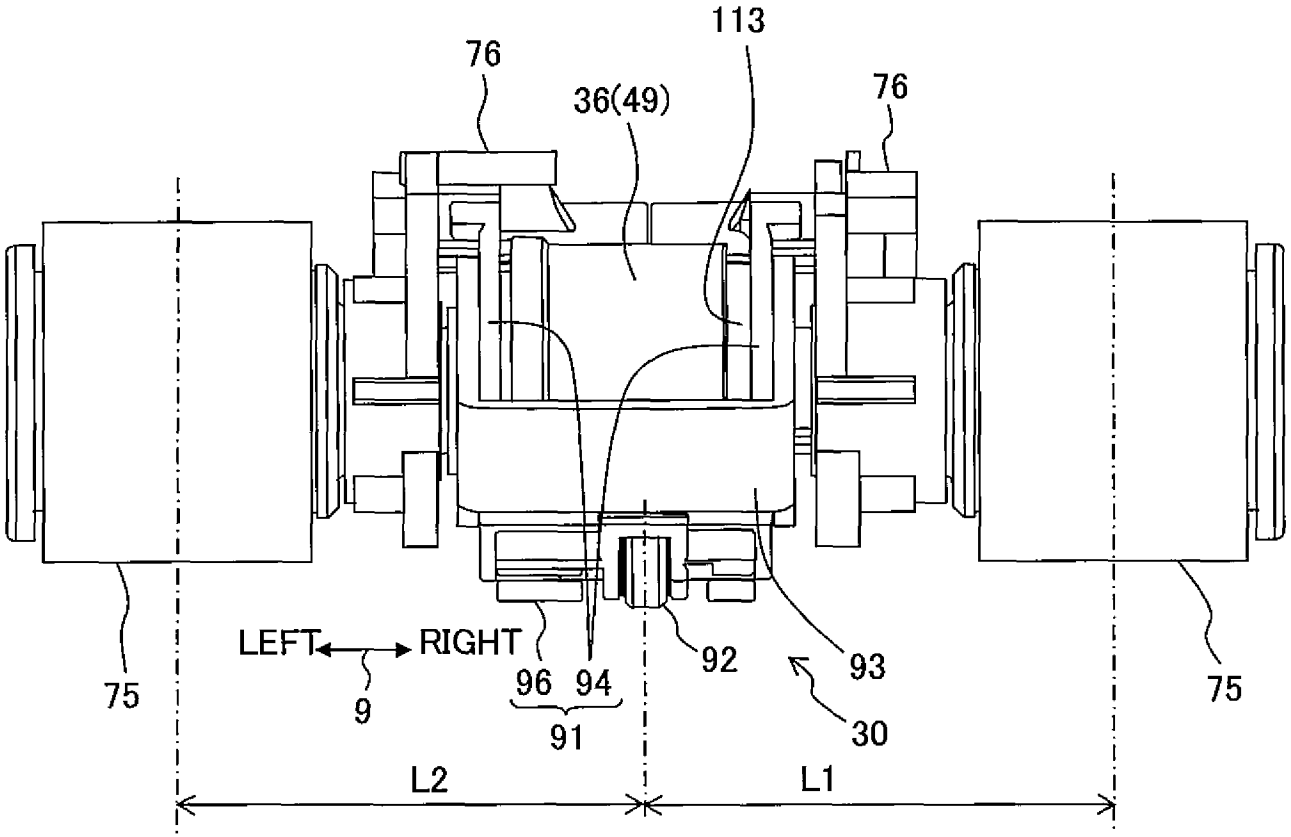
FIG. 13 is a front view of the surrounding portion of the feeding arm 76.

As depicted in FIG. 13, the roller 92 is arranged at an intermediate position equidistant from each feeding roller 75 in the pair of feeding rollers 75 in the left-right direction 9. In other words, a distance L1 in the left-right direction 9 between the roller 92 and the feeding roller 75 on the right side is same as a distance L2 in the left-right direction 9 between the roller 92 and the feeding roller 75 on the left side.

As depicted in FIG. 12B, the pinching member 93 includes a pair of side plates 101, and a connecting plate 102 which joins the pair of side plates 101. A material of the pinching member 93 is a metal such as SECC (electrolytic zinc-coated steel sheet).

As depicted in FIG. 8, the side plate 101 on the right side is disposed between the side plate 94 on the right side of the pivot body 91 and the side plate 111 on the right side of the feeding arm 76. The side plate 101 which is invisible being at a hidden position in FIG. 8, is arranged between the side plate 94 on the left side of the pivot body 91 and the side plate 111 on the left side of the feeding arm 76. In other words, the pair of side plates 101 of the pinching member 93 is arranged on an outer side of the pair of side plates 94 of the pivot body 91 in the left-right direction 9. Or, the pinching member 93 is sandwiching the pair of side plates 94 of the pivot body 91.

As depicted in FIG. 12B, an opening 103A is provided at a central portion of the side plate 101 on the left side, and an opening 103B is provided at a central portion of the side plate 101 on the right side. The rotating shaft 83 of the feeding roller 75 is inserted through each of the openings 103A and 103B. Here, the opening 103A in the side plate 101 on the left side has a circular shape. However, a radius of a part of the opening 103B in the side plate 101 on the right side is larger than a radius of a portion other than that part of the opening 103B. In other words, the opening 103B has a shape in which parts of two circular-shaped openings having different radii are combined upon letting to be concentric. Moreover, a rib 104 which is provided to the side plate 94 on the right side of the pivot body 91 is fitted into an opening portion for which a radius in the opening 103B is large (refer to FIG. 12A). By such arrangement, the pair of side plates 101 is capable of rotating integrally with the pivot body 91 with the rotating shaft 83 of the feeding roller 75 as a center. Consequently, the pivot body 91 and the pinching member 93 are pivoted integrally with the rotating shaft 83 of the feeding roller 75 as the center. In other words, the pivot body 30 is pivoted with the rotating shaft 83 of the feeding roller 75 as a center.

The pivot body 91 of the pivot member 30 is connected to the gear 49 via a torque limiter 32 which will be described later. As aforementioned, the rotating shaft 83 of the feeding roller 75 is inserted through the gear 49, and the gear 49 and the feeding roller 75 are rotatable integrally with the rotating shaft 83 as a center. In other words, the pivot member 30 is connected to the feeding roller 75 via the torque limiter 32 and the gear 49. Moreover, the pivot member 30 is imparted rotational driving force of the motor 78 from the gear 49 of the second drive transmission section 36 via the torque limiter 32. Accordingly, the pivot member 30 is pivoted in the directions of the arrows 105 and 106 (refer to FIG. 6).

As depicted in FIG. 12B, a projection 109 which is projected to be directed toward an outer side of a radial direction of the feeding roller 75 is provided to a peripheral surface of the pair of side plates 94 of the pivot body 91. On the other hand, the pair of side plates 111 of the feeding arm 76 is provided with a first regulating portion 107 and a second regulating portion 108. The first regulating portion 107 and the second regulating portion 108 regulate pivoting of the pivot body 91 by being contacted with the projection 109. In the present embodiment, the first regulating portion 107 and the second regulating portion 108 are ribs projected to be directed from one side plate in the pair of side plates 111 toward the other side plate in the pair of side plates 111. The first regulating portion 107 and the second regulating portion 108 are not restricted to be ribs, provided that they are capable of regulating pivoting of the pivot body 91 by being contacted with the pivot body 91.

Figure 16A:
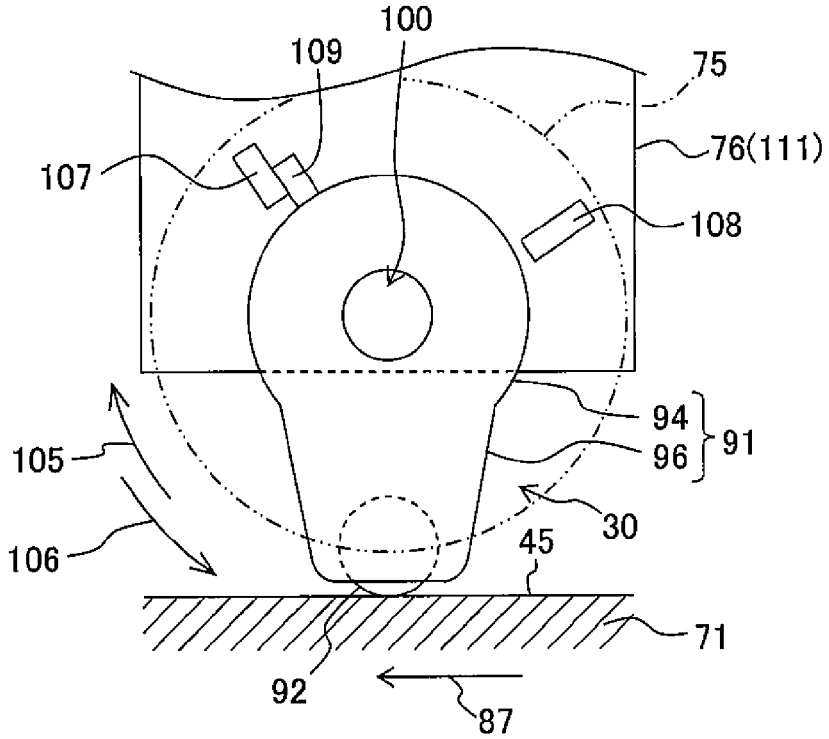
FIG. 16A and FIG. 16B are right-side views showing schematically the bypass tray 71, the feeding arm 76, and the pivot member 30, where, in FIG. 16A, a state in which the pivot member 30 is at the first position is shown, and in FIG. 16B, a state in which the pivot member 30 is at the second position is shown.

As depicted in FIG. 16A, the projection 109 contacts with the first regulating portion 107 from an upstream side of the direction of the arrow 106. In a state of the projection 109 and the first regulating portion 107 being contacted with each other, the projection 96 and the roller 92 of the pivot member 30 are projected toward the flat surface 45 of the bypass tray 71 from the feeding roller 75. A position of the pivot member 30 in the state depicted in FIG. 16A will hereinafter be referred to as a second position. In other words, the first regulating member 107 regulates pivoting of the pivot member 30 at the second position.

As aforementioned, the bias is applied to the feeding arm 76 by the torsion spring toward the flat surface 45 of the bypass tray 71. Therefore, when the pivot member 30 is at the second position, the roller 92 contacts with the flat surface 45 of the bypass tray 71 or with the recording paper that has been supported by the flat surface 45. The feeding roller 75, by being lifted up by the pivot member 30, is separated from the flat surface 45 of the bypass tray 71 or from the recording paper supported by the flat surface 45.

Figure 16B:
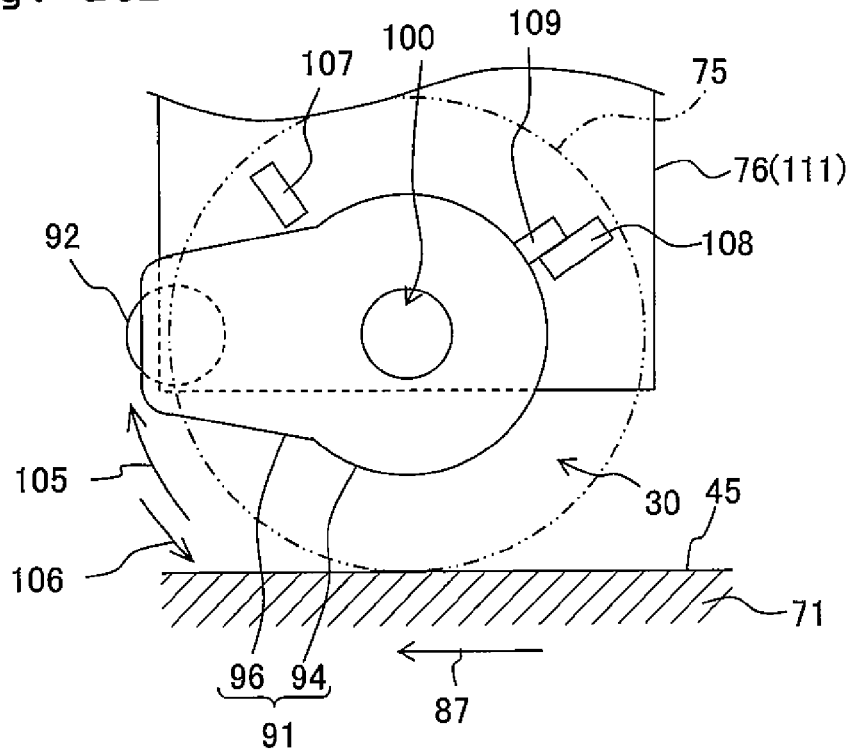

As depicted in FIG. 16B, the projection 109 contacts with the second regulating portion 108 from an upstream side of the direction of the arrow 105. In a state of the projection 109 and the second regulating portion 108 being contacted with each other, the projection 96 and the roller 92 of the pivot member 30 are retracted from the feeding roller 75 with respect to the flat surface 45 of the bypass tray 71. A position of the pivot member 30 in the state depicted in FIG. 16B will hereinafter be referred to as a fourth position. In other words, the second regulating portion 108 regulates pivoting of the pivot member 30 at the fourth position.

When the pivot member 30 is at the fourth position, the roller 92 is separated from the flat surface 45 of the bypass tray 71. On the other hand, the bias is applied to the feeding arm 76 by the torsion spring toward the flat surface 45 of the bypass tray 71. As a result, the feeding roller 75 contacts with the flat surface 45 of the bypass tray 71 or with the recording paper supported by the flat surface 45.

Thus, by the pivoting of the pivot member 30 being regulated by the first regulating portion 107 and the second regulating portion 108, the pivot member 30 is capable of pivoting only in a range between the third position and the fourth position.

[Torque Limiter]

The torque limiter 32 transmits the pivot driving force from the second drive transmission section 36 to the pivot member 30. Moreover, in a case in which the pivoting of the pivot member 30 has been regulated by the first regulating portion 107 or the second regulating portion 108, the torque limiter 32 cuts off the transmission of the pivot driving force from the second drive transmission section 36 to the pivot member 30.

As depicted in FIG. 12B, the torque limiter 32 includes a friction member 113 and the helical compression spring 114.

The friction member 113 is a thin and circular cylindrical-shaped member. The shape of the friction member 113 can be arbitrary. The friction member 113 is arranged between the gear 49 and the side plate 94 on the left side of the pivot body 91. In other words, the torque limiter 32 which includes the friction member 113 is provided between the second drive transmission section 36 which includes the gear 49, and the pivot member 30. As depicted in FIG. 12A and FIG. 12B, one surface of the friction member 113 contacts with the bottom surface 110 of the gear 49. A surface on a rear side of the other surface of the friction member 113 contacts with the side plate 94 on the right side. The friction member 113 is formed of a material such as felt, having a coefficient of friction higher than a coefficient of friction of the gear 49 and the side plate 94. Thus the friction member 113 transmits the pivot driving force from the gear 49 to the side plate 94, or in other words, from the second drive transmission section 36 to the pivot member 30.

As depicted in FIG. 12B, an opening 115 is provided at a central portion of the friction member 113. The rotating shaft 83 of the feeding roller 75 is inserted through the opening 115.

The friction member 113 may be arranged between the gear 49 and the side plate 94 on the left side. Moreover, two friction members 113 may be provided and one of the friction members 113 may be arranged between the gear 49 and the side plate 94 on the right side, and the other friction member 113 may be arranged between the gear 49 and the side plate 94 on the left side.

The helical compression spring 114 is arranged inside the recess 54 of the gear 49. One end of the helical compression spring 114 contacts with the bottom surface 110 of the gear 49 (inner side surface inside the recess 54). The other end of the helical compression spring 114 contacts with the side plate 94 on the left side in the pivot body 91. The rotating shaft 83 of the feeding roller 75 is inserted through a central portion of the helical compression spring 114.

The left and right of the gear 49 may be reversed. In this case, the bottom surface 110 is positioned on the left side of the gear 49. Therefore, the one end of the helical compression spring 114 contacts with the side plate 94 on the right side of the pivot body 91, and the other end of the helical compression spring 114 contacts with the bottom surface 110 (inner side surface inside the recess 54). Thus, the helical compression spring 114 is arranged between the one of the side plates 94 and the gear 49.

The helical compression spring 114 arranged inside the recess 54 of the gear 49, while tending to return to the original length, exerts a rightward force and a leftward force in the left-right direction 9. Due to the rightward force exerted by the helical compression spring 114, the bottom surface 110 of the gear 49 makes a pressed contact with the friction member 113. In other words, the helical compression spring 114 applies bias on the gear 49 toward the friction member 113.

Figure 15A:
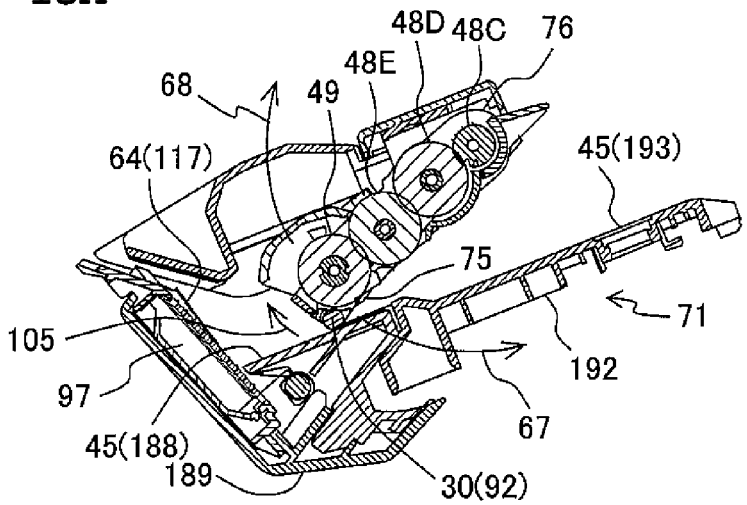
FIG. 15A, FIG. 15B, and FIG. 15C are cross-sectional views along a line XV-XV in FIG. 5, where, in FIG. 15A, a state in which the pivot member 30 is at a first position and the contact member 117 of the moving member 64 is at the projected position is shown, in FIG. 15B, a state in which the pivot member is at the first position and the contact member 117 of the moving member 64 is at the retracted position is shown, and in FIG. 15C, a state in which the pivot member 30 is at a second position and the contact member 117 of the moving member 64 is at the retracted position is shown.

In a state depicted in FIG. 15A and a state depicted in FIG. 16A, as the feeding roller 75 rotates in the direction of the arrow 125 (refer to FIG. 6) due to the rotational driving force of normal rotation being applied from the motor 78 via the drive switching section 133, the main-body side drive transmission section 134, the first drive transmission section 35, and the second drive transmission section 36, the rotational driving force is transmitted to the pivot member 30 via the torque limiter 32. Accordingly, the pivot member 30 is pivoted in the direction of the arrow 105 from the third position (the position of the pivot member 30 when in the state depicted in FIG. 15A and FIG. 16A) to the fourth state (the position of the pivot member 30 when in the state depicted FIG. 15C and FIG. 16B). In other words, the pivot member 30 is pivoted integrally with the rotating feeding roller 75.

As the projection 109 of the pivot member 30 contacts with the second regulating portion 108, or in other words, as the pivot member 30 reaches the fourth position (refer to FIG. 15C and FIG. 16B), the pivoting of the pivot member 30 is stopped. Accordingly, out of the feeding roller 75 and the pivot member 30, only the feeding roller 75 continues to rotate in the direction of an arrow 125 resisting the frictional force exerted by the friction member 113. In other words, the transmission of the pivot driving force to the pivot member 30 is cut off by the torque limiter 32.

Figure 15B:
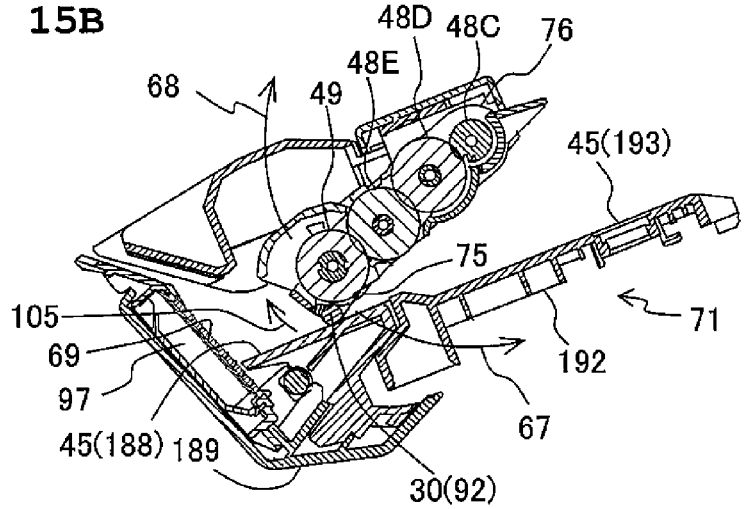
Figure 15C:
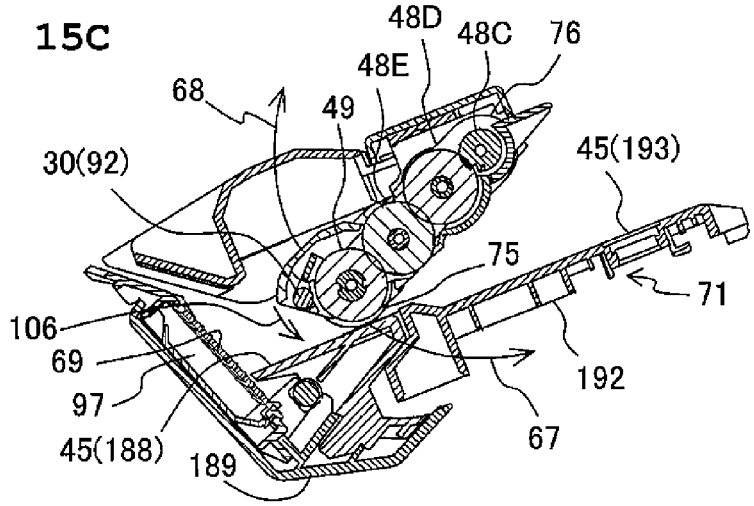

On the other hand, as depicted in FIG. 15C and FIG. 16B, the rotational driving force of reverse rotation is applied to the feeding roller 75 from the motor 78 via the drive switching section 133, the main-body side drive transmission section 134, the first drive transmission section 35, and the second drive transmission section 36. As the feeding roller 75 rotates in the direction of an arrow 126 (refer to FIG. 6) due to the rotational driving force of reverse direction being applied to the feeding roller 75, the rotational driving force is transmitted to the pivot member 30 via the friction member 113 of the torque limiter 32. Accordingly, the pivot member 30 is pivoted in the direction of the arrow 106 from the fourth position to the third position. In other words, the pivot member 30 is pivoted integrally with the rotating feeding roller 75.

As the projection 109 of the pivot member 30 contacts with the first regulating portion 107, or in other words, as the pivot member 30 reaches the third position (refer to FIG. 15A and FIG. 16A), the pivoting of the pivot member 30 is stopped. Accordingly, out of the feeding roller 75 and the pivot member 30, only the feeding roller 75 continues to rotate in the direction of the arrow 126 resisting the frictional force exerted by the friction member 113. In other words, the transmission of the pivot driving force to the pivot member 30 is cut off by the torque limiter 32.

[Moving Member 64]

As depicted in FIG. 7, the moving member 64 is arranged in the recess 86 which is provided in the upper surface 69 of the lower-side guide member 97. In other words, the moving member 64 is provided to the lower-side guide member 97. The feeding section is formed by the feeding roller 75, the feeding arm 76, the lower-side guide member 97, the moving member 64, and the torque limiter 127.

Figure 14B:
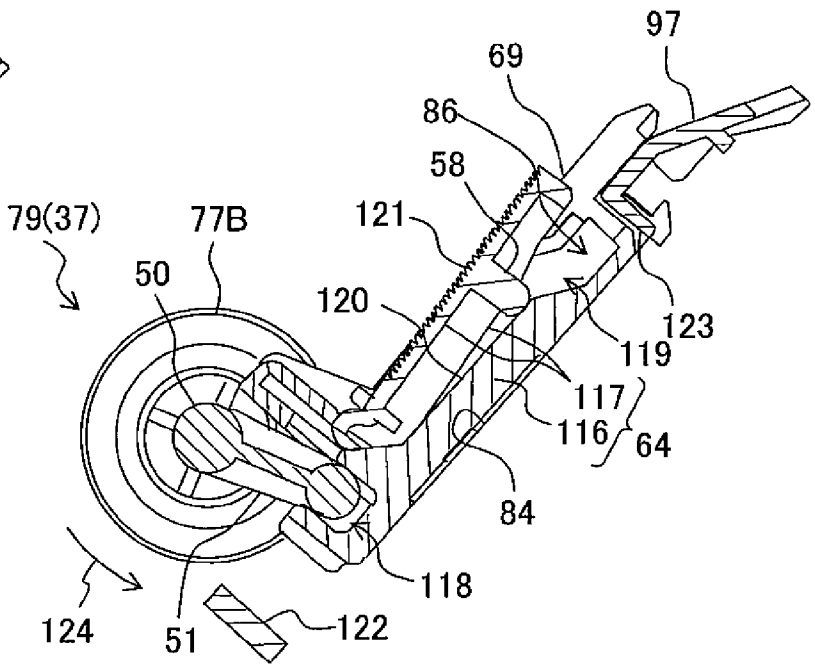
FIG. 14A and FIG. 14B are diagrams showing a surrounding area of a lower-side guide member 97 in a cross-sectional view along a line XIV-XIV in FIG. 5, where.
Figure 14A:
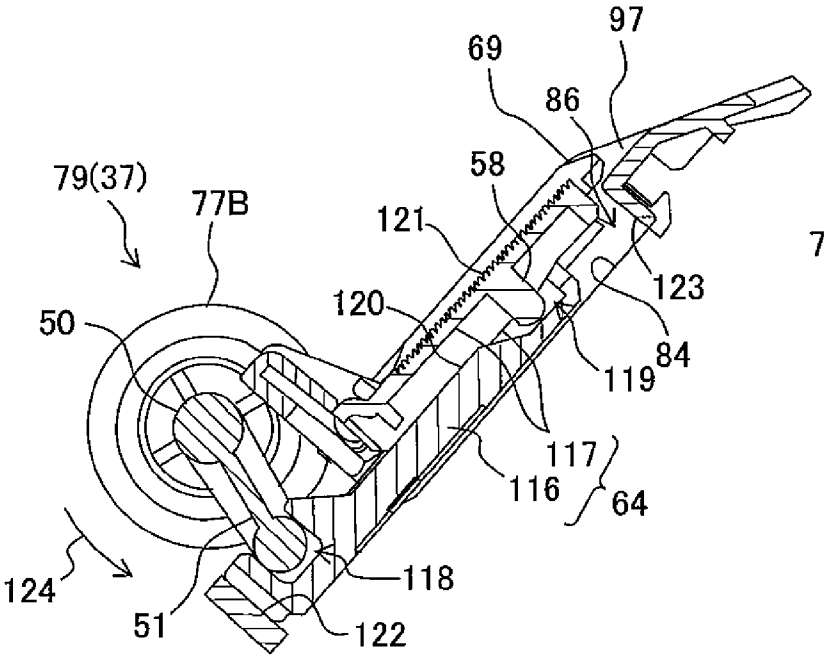

As depicted in FIG. 14A and FIG. 14B, the moving member 64 includes a sliding member 116 and an contact member 117. The sliding member 116 is supported by the bottom surface 84 of the recess 86. The contact member 117 is supported by the sliding member 116, and is capable of contacting with a front end of the recording paper supported by the bypass tray 71.

The sliding member 116 is movable in the front-rear direction 8 along the bottom surface 84 of the recess 86. A first recess 118 and a second recess 119 are provided in a surface 120 of the sliding member 116, or in other words, in a surface 120 on an opposite side of a surface of the sliding member 116 which is in contact with the bottom surface 84 of the recess 86. The projection 51 of the third drive transmission section 37 is inserted into the first recess 118. A projection 58 of the contact member 117 which will be described later is insertable into the second recess 119.

The contact member 117 contacts with the surface 120 of the sliding member 116. The contact member 117 includes the projection 58 which is projected toward the sliding member 116. The contact member 117, in conjunction with the movement of the sliding member 116, is movable to a projected position of being projected from the upper surface of the lower-side guide member 97 (a position of the contact member 117 when in a state depicted in FIG. 14B) and to a retracted position of being retracted from the upper surface 69 (a position of the contact member 117 when in a state depicted in FIG. 14A).

The description in detail follows. As depicted in FIG. 14A, in a state of the sliding member 116 contacting with the first side surface 122 of the recess 86 of the lower-side guide member 97, the projection 58 of the contact member 117 is inserted into the second recess 119 of the sliding member 116. In this state, the contact member 117 is retracted into the recess 86 from the upper surface 69, and is at the retracted position.

In this state, as the gear 77B of the third drive transmission section 37 rotates in a direction of an arrow 124, the sliding member 116 is pushed by the projection 51 which was pivoted integrally with the rotating gear 77B, and moved toward the second side surface 123 of the recess 86. Accordingly, the projection 58 which had been inserted into the second recess 119 escapes from the second recess 119, and is supported by the surface 120 as depicted in FIG. 14B. In other words, the surface 120 of the sliding member 116 forms a cam surface. As a result, a surface 121 of the contact member 117 is projected from the upper surface 69 of the lower-side guide member 97. In other words, the contact member 117 assumes the projected position.

The sliding member 116 is capable of moving till the sliding member 116 contacts with the second side surface 123. In other words, the second side surface 123 regulates the movement of the contact member 117 of the moving member 64 by the projected position by regulating the movement of the sliding member 116 by contacting with the sliding member 116 of the moving member 64. The second side surface 123 corresponds to a projected regulating portion.

As depicted in FIG. 14B, in a state of the sliding member 116 being contacted with the second side surface 123, and the contact member 117 in the projected position, the gear 77B is capable of rotating in an opposite direction of the arrow 124. At this time, the sliding member 116 is pushed by the projection 51, and moves toward the first side surface 122 of the recess 86. Accordingly, the projection 58 moves while being contacted with the surface 120, and is inserted into the second recess 119 as depicted in FIG. 14A. As a result, the surface 121 of the contact member 117 is retracted into the recess 86 from the upper surface 69 of the lower-side guide member 97. In other words, the contact member 117 assumes the retracted position. The first side surface 122 corresponds to a refracted regulating portion.

The sliding member 116 is capable of moving till the sliding member 116 contacts with the first side surface 122. In other words, the first side surface 122 regulates the movement of the contact member 117 of the moving member 64 by the retracted position by regulating the movement of the sliding member 116 by contacting with the sliding member 116 of the moving member 64.

Figure 5:
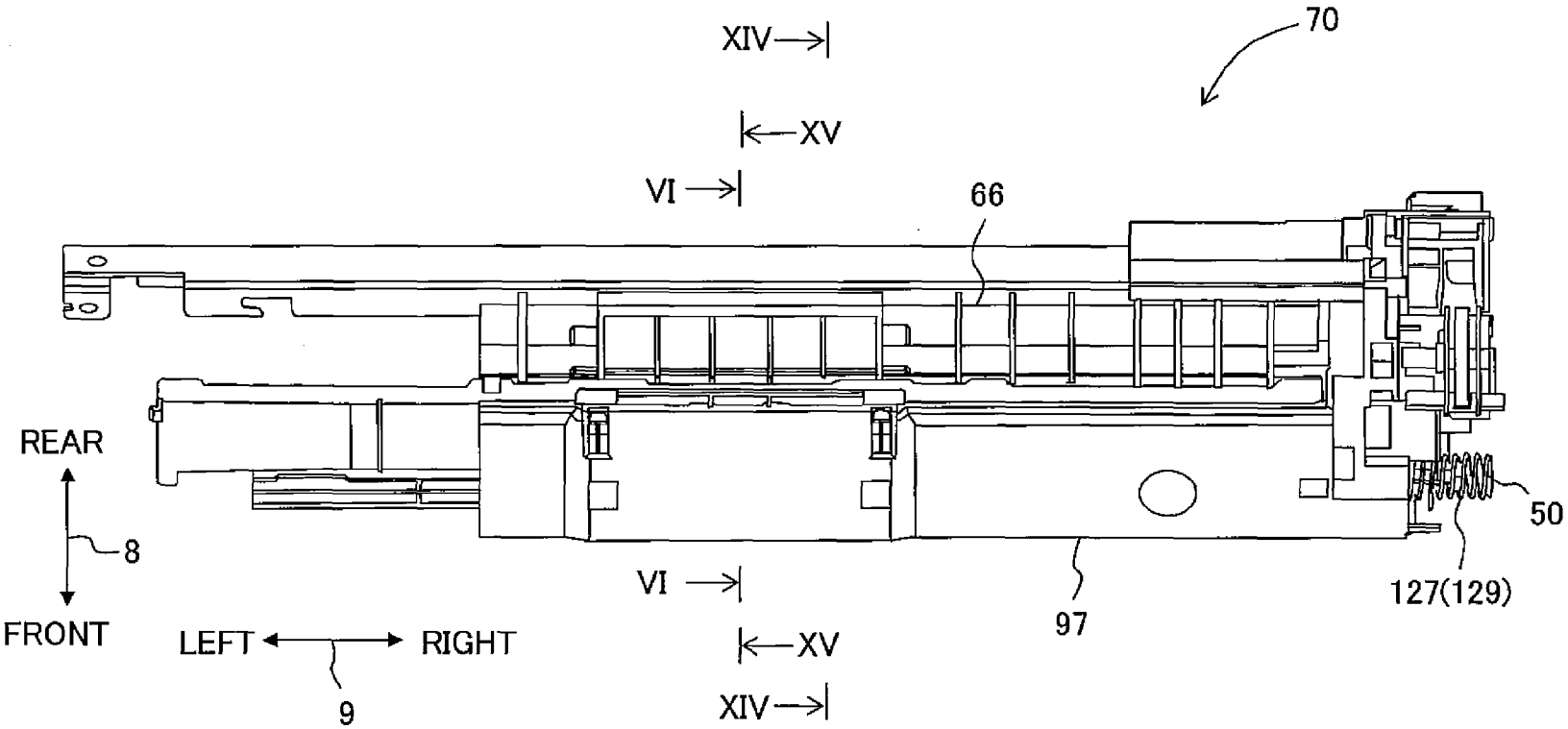
FIG. 5 is a front view of a feeding unit 70.

The torque limiter 127 is provided between the pivot shaft 50 and the gear 77B of the third drive transmission section 37 (refer to FIG. 5 and FIG. 7). The torque limiter 123 switches to either allowing or cutting-off the transmission of the rotational driving force in the third drive transmission section 37.

The torque limiter 127 includes a flange portion 128 (refer to FIG. 7), a friction member (not depicted in the diagram), and a helical compression spring 129 (refer to FIG. 5). The flange portion 128 is projected from a peripheral surface of the pivot shaft 50. The friction member (not depicted in the diagram) is arranged between the flange portion 128 and the gear 77B. The helical compression spring 129 is arranged on an opposite side of the friction member with respect to the gear 77B, and applies bias on the gear 77B toward the friction member. The gear 77B is pushed or pressed against the flange portion 128 via the friction member by the bias being applied by the helical compression spring 129. An arrangement of the torque limiter 127 is not restricted to the abovementioned arrangement, and an arbitrary arrangement of the torque limiter may be adopted.

In abovementioned movement of the moving member 64, in a case in which the sliding member 116 is in a movable state, the torque limiter 127 transmits the rotational driving force from the gear 77B to the flange portion 128 via the friction member. In other words, the gear 77B and the pivot shaft 50 which is provided with the flange portion 128 rotate integrally via the torque limiter 127.

On the other hand, in the abovementioned movement of the moving member 64, in a case in which the sliding member 116 moving toward the first side surface 122 contacts with the first side surface 122, the torque limiter 127 cuts off the transmission of the rotational driving force from the gear 77B to the pivot shaft 50. Or, in a case in which the sliding member 116 moving toward the second side surface 123 contacts with the second side surface, the torque limiter 127 cuts off the transmission of the rotational driving force from the gear 77B to the pivot shaft 50. In other words, since the rotation of the pivot shaft 50 is regulated by contacting with the first side surface 122 or the second side surface 123 of the sliding member 116, the rotation of the pivot shaft 50 stops and the gear 77B spins freely with respect to the pivot shaft 50. In other words, the gear 77B rotates independently of the pivot shaft 50. Thus, as the movement of the moving member 64 is regulated by the first side surface 122 or the second side surface 123, the torque limiter 127 cuts off the transmission of the rotational driving force in the third drive transmission section 37.

The position at which the torque limiter 127 is to be provided is not restricted to a position between the gear 77B and the pivot shaft 50. For instance, the torque limiter 127 may be provided between the gear 77B and the rotating shaft of the gear 77B.

When the contact member 117 is at the projected position, the recording paper fed in the feeding direction 87 is capable of contacting with the surface 121 of the contact member 117 (refer to FIG. 14). Due to grooves extended in the left-right direction (direction perpendicular to a paper surface in FIG. 2) being formed at a constant interval, the surface 121 is serrated in a side view from the right side or the left side. Accordingly, the front end of the recording paper contacted with the surface 121, or in other words, a downstream end of the recording paper in the feeding direction 87, is fitted in the groove. As a result, the movement of the recording paper is stopped. The surface 121 may be serrated provided that the surface 121 is capable of stopping the recording paper that has contacted. For example, the surface 121 may be a surface which stops the movement of the recording paper which has contacted by a material such as cork having a high coefficient of friction being stuck thereon. The surface 121 corresponds to a contact surface.

[Operation of the Feeding Unit 70]

A movement of the feeding unit 70 when the motor 78 rotates in the normal direction and the reverse direction will be described below. Let us assume that a state depicted in FIG. 15A is an initial state. Moreover, switching gear 171 in the drive switching section is at the second position. In FIG. 15A, FIG. 15B, and FIG. 15C, for making an operation of each arrangement of the feeding unit 70 easily understandable, the recording paper is not described. In the following description, let us assume that a plurality of recording papers is supported by the flat surface 45 of the bypass tray 71.

Firstly, an operation of the feeding unit 70 in a case in which the motor 78 rotates in the normal direction in the initial state depicted in FIG. 15A will be described. In the state depicted in FIG. 15A, the pivot member 30 is at a first position. At this time, as aforementioned, the roller 92 contacts with the recording paper supported by the flat surface 45 of the bypass tray 71. On the other hand, the feeding roller 75, by being lifted up by the pivot member 30, is at an alienated position of being separated apart from the recording paper. In the state depicted in FIG. 15A, the contact member 117 of the moving member 64 is at the projected position, and the sliding member 116 of the moving member 64 contacts with the second side surface 123 (refer to FIG. 14B).

In this state, as the motor 78 rotates in the normal direction, the rotational driving force of the normal rotation of the motor 78 is transmitted to the feeding roller 75 via the drive switching section 133, the main-body side drive transmission section 134, the first drive transmission section 35, the intermediate gear 46, and the second drive transmission section 36. Moreover, the rotational driving force of the normal rotation of the motor 78 is transmitted also to the pivot member 30 via the drive switching section 133, the main-body side drive transmission section 134, the first drive transmission section 35, the intermediate gear 46, the second drive transmission section 36, and the torque limiter 32. Furthermore, the rotational driving force of the normal rotation of the motor 78 is transmitted to the moving member 64 via the drive switching section 133, the main-body side drive transmission section 134, the first drive transmission section 35, the intermediate gear 46, and the third drive transmission section 37.

By the rotational driving force of the normal rotation of the motor 78 being transmitted, the feeding roller 75 rotates in the direction of the arrow 125 (direction of feeding the recording paper in the feeding direction 87, refer to FIG. 6), and the pivot member 30 rotates in the direction of the arrow 105 (direction from the third position toward the fourth position).

As the pivot member 30 is pivoted from the third position to the fourth position, the roller 92 is separated apart from the recording paper. Accordingly, the bias is applied to the feeding arm 76 by the torsion spring, and the feeding arm 76 is pivoted in the direction of the arrow 67. As a result, the feeding roller 75 which had been lifted up by the pivot member 30 moves from the alienated position (position of the feeding roller 75 when in the state depicted in FIG. 15A) toward an contacting position (position of the feeding roller 75 when in the state depicted in FIG. 15C) of contacting with the recording paper supported by the bypass tray 71. Accordingly, as the rotational driving force in the normal rotation is applied from the motor 78, the pivot member 30 moves the feeding roller 75 from the alienated position to the contacting position.

In the state depicted in FIG. 15A, the feeding roller 75 is separated from the recording paper. In other words, the feeding roller 75 is not contacting with the recording paper. Therefore, even if the feeding roller 75 rotates in the direction of the arrow 125 (refer to FIG. 6) in the state depicted in FIG. 15A, the feeding roller 75 does not feed the recording paper in the feeding direction 87. The feeding roller 75 starts feeding the recording paper in the feeding direction 87 when the feeding roller 75 rotating in the direction of the arrow 125 reaches the contacting position by the roller 92 being separated apart due to the pivoting of the pivot member 30 toward the second position.

Moreover, by the rotational driving force in the normal direction of the motor 78 being transmitted, the pivot shaft 50 of the third drive transmission section 37 rotates in a direction opposite to the direction of the arrow 24 as depicted in FIG. 14B. Accordingly, the sliding member 116 of the moving member 64, by being pushed by the projection 51, moves from the second side surface 123 toward the first side surface 122. As a result, the contact member 117 of the moving member 64 moves from the projected position toward the retracted position.

Here, as aforementioned, the second drive transmission section 36, due to having an arrangement of the key 73 and the key groove 74, the gear 48B has a play in the circumferential (peripheral) direction. Accordingly, there is a delay in the transmission of the rotational driving force from the gear 48B to the pivot shaft 66. As a result, after the start of the normal rotation of the motor 78, a timing of start of rotation of the feeding roller 75 and a timing of start of pivoting of the pivot member 30 are after a timing of start of the movement of the moving member 64. Moreover, the time after the pivoting of the pivot member 30 has started till the feeding roller 75 contacts with the recording paper and the time after the contact member 117 of the moving member 64 starts movement from the projected position toward the retracted position till reaching the retracted position differ.

The length of the key 73 and a length of the key groove 74 in the circumferential direction of the gear 48 have been determined to satisfy the following condition, based on the difference in the timing and the difference in the time mentioned above.

The condition is that the contact member 117 has moved from the projected position to the retracted position before the feeding roller 75 moves from the alienated position to the contacting position. In other words, the pivot member 30 moves the feeding roller 75 from the alienated position to the contacting position by the normal rotation of the motor 78 being started and the driving force of the motor 78 being transmitted to the pivot member 30 via the drive switching section 133, the main-body side drive transmission section 134, the first drive transmission section 35, the intermediate gear 46, and the second drive transmission section 36, in a state in which the contact member 117 of the moving member 64 is at the projected position, and the feeding roller 75 is at the alienated position (refer to FIG. 15A). Let the time required for the movement be T1. On the other hand, the contact member 117 of the moving member 64 moves from the projected position to the retracted position by the normal rotation of the motor 78 being started, and the driving force of the motor 78 being transmitted to the moving member 64 via the drive switching section 133, the main-body side drive transmission section 134, the first drive transmission section 35, the intermediate gear 46, and the third drive transmission section 37. Let the time required for the movement be T2. At this time, T1 is to be set to be longer than T2 (T1>T2).

Thus, the timing at which the feeding roller 75 contacts with the recording paper is after the timing at which the contact member 117 of the moving member 64 reached the refracted position. In other words, in a case in which the motor 78 has started the normal rotation in the state depicted in FIG. 15A, the moving member 64 which has started moving from the projected position, first reaches the retracted position (refer to FIG. 15B). At this time, the feeding roller 75 has not yet contacted with the recording paper. In other words, the feeding roller 75 has not yet reached the contacting position. Next, the feeding roller 75 contacts with the recording paper (refer to FIG. 15C). In other words, the feeding roller 75 which has started moving from the alienated position by the pivoting of the pivot member 30 reaches the contacting position.

The recording paper with which the feeding roller 75 has contacted, is fed in the feeding direction 87 by the rotation of the feeding roller 75 in the direction of the arrow 125 (refer to FIG. 6). At the same time as the feeding roller 75 reaches the contacting position, or, after the feeding roller 75 has reached the contacting position, the pivot member 30 reaches the fourth position. Moreover, at the same time as the contact member 117 of the moving member 64 reaches the retracted position, or, after the contact member 117 of the moving member 64 has reached the retracted position, the sliding member 116 of the moving member 64 contacts with the first side surface 122 (refer to FIG. 14A).

Next, an operation of the feeding unit 70 in a case in which the motor 78 rotates in the reverse direction in a state depicted in FIG. 15C will be described below. In the state depicted in FIG. 15C, the pivot member 30 is at the fourth position. At this time, as aforementioned, the roller is separated apart from the recording paper supported by the flat surface 45 of the bypass tray 71. On the other hand, the feeding roller 75 is contacting with the recording paper supported by the flat surface 45 of the bypass tray 71. In other words, the feeding roller 75 is at the contacting position. Moreover, in the state depicted in FIG. 15C, the contact member 117 of the moving member 64 is at the retracted position, and the sliding member 116 of the moving member 64 is contacting with the first side surface 122 (refer to FIG. 14A).

In this state, as the motor 78 is rotated in the reverse direction, the rotational driving force of the reverse rotation of the motor 78 is transmitted to the feeding roller 75 via the drive switching section 133, the main-body side drive transmission section 134, the first drive transmission section 35, the intermediate gear 46, and the second drive transmission section 36. Moreover, the rotational driving force of the reverse rotation of the motor 78 is transmitted also to the pivot member 30 via the drive switching section 133, the main-body side drive transmission section 134, the first drive transmission section 35, the intermediate gear 46, the second drive transmission section 36, and the torque limiter 32. Furthermore, the rotational driving force of the reverse rotation of the motor 78 is transmitted also to the moving member 64 via the first drive transmission section 35, the intermediate gear 46, and the third drive transmission section 37.

By the rotational driving force of the reverse rotation of the motor 78 being transmitted, the feeding roller 75 rotates in the direction of the arrow 126 (direction of feeding the recording paper in a direction opposite to the feeding direction 87, refer to FIG. 6), and the pivot member 30 is pivoted in the direction of the arrow 106 (direction from the second position toward the first position).

As the pivot member 30 is pivoted from the fourth position toward the third position, firstly, the roller 92 contacts with the recording paper. As the pivot member 30 is further pivoted from the second position to the first position, the roller 92 lifts the feeding roller 75 up. With the lifting up of the feeding roller 75, the feeding arm 76 is pivoted in the direction of the arrow 68 resisting the bias applied by the torsion spring. As a result, the feeding roller 75 moves from the contacting position to the alienated position. Thus, as the rotational driving force of the reverse rotation is applied from the motor 78, the pivot member 30 moves the feeding roller 75 from the contacting position to the alienated position.

Moreover, by the rotation driving force of the reverse rotation of the motor 78 being transmitted, the pivot shaft 50 of the third drive transmission section 37 is pivoted in the direction of the arrow 124 as depicted in FIG. 14A. Accordingly, the sliding member 116 of the moving member 64, by being pushed by the projection 51, moves in a direction from the first side surface 122 toward the second side surface 123. As a result, the contact member 117 of the moving member 64 moves from the retracted position to the projected position.

Here, as aforementioned, the second drive transmission section 36, by having an arrangement of the key 73 and the key groove 74, the gear 48B has a play in the circumferential direction. Accordingly, similarly as in the case in which the motor 78 rotates in the normal direction, there is a delay in the transmission of the rotational driving force from the gear 48B to the pivot shaft 66. As a result, after the start of the reverse rotation of the motor 78, a timing of start of rotation of the feeding roller 75 and a timing of start of rotation of the pivot member 30 is after a timing of start of movement of the moving member 64. Moreover, the time after the pivoting of the pivot member 30 has started, till the feeding roller 75 is separated apart from the recording paper, and the time after the contact member 117 of the moving member 64 starts movement from the retracted position toward the projected position, till reaching the projected position differ.

Therefore, a timing at which the feeding roller 75 is separated apart from the recording paper is after a timing at which the contact member 117 of the moving member 64 reaches the projected position. In other words, in a case in which the motor 78 rotates in the reverse direction in the state depicted in FIG. 15C, firstly, the moving member 64, which has started moving from the refracted position, reaches the projected position, and then, the feeding roller 75, which has started moving from the contacting position, reaches the alienated position.

At the same time as the feeding roller 75 reaches the alienated position, or after the feeding roller 75 has reached the alienated position, the pivot member 30 reaches the third position. Moreover, at the same time as the contact member 117 of the moving member 64 reaches the projected position, or after the contact member 117 of the moving member 64 has reached the projected position, the sliding member 116 of the moving member 64 contacts with the second side surface 123 (refer to FIG. 14B).

[Control Section 152]

Figure 17:
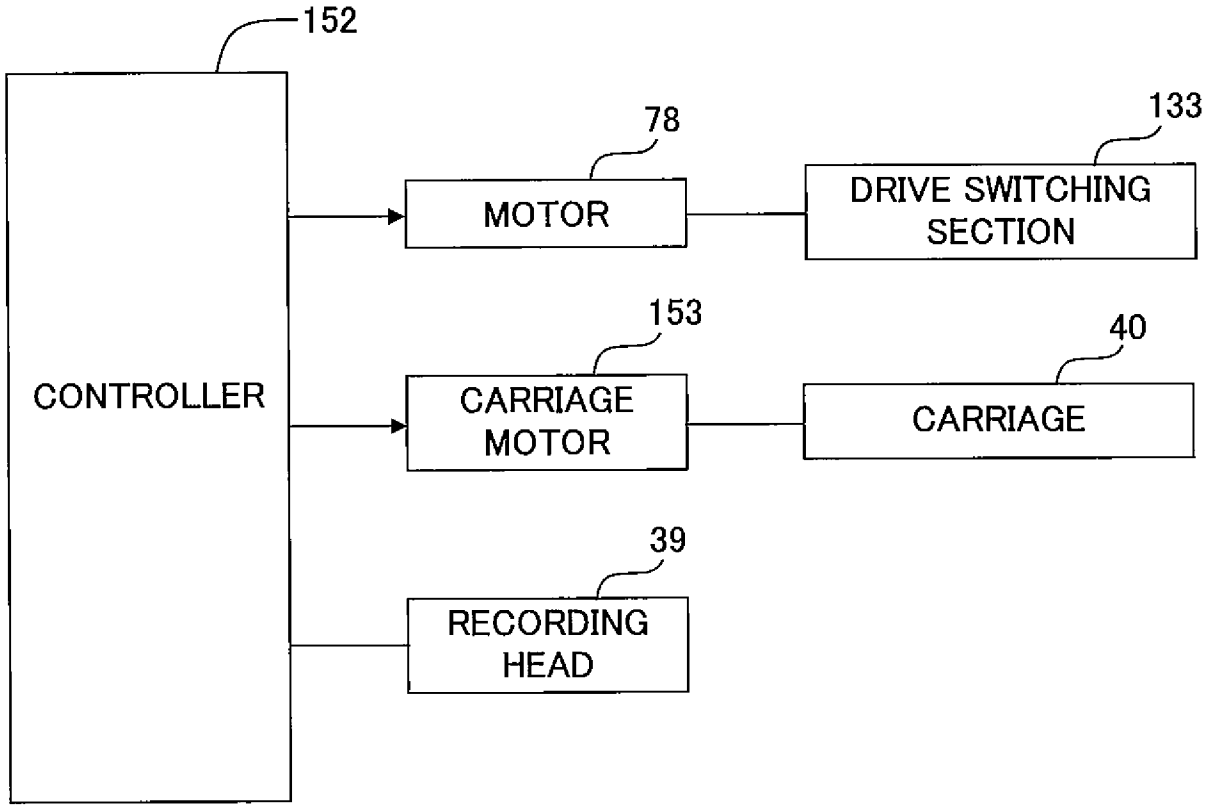
FIG. 17 is a block diagram showing a configuration of a control section 152.

A control section 152 depicted in FIG. 17 controls an overall operation of the multi-function peripheral 10. The control section 152 is arranged as a micro-computer including mainly components such as a CPU (central processing unit), a ROM (read only memory), a RAM (random access memory), an EEPROM (electrically erasable and programmable read only memory), and an ASIC (application specific integrated circuit). The control section 152 corresponds to a conveying control section and a recording control section. A configuration of the control section 152 is not restricted particularly, and may be configured such that a plurality of CPUs shares and executes various processing. A single or a plurality of ASICs may be provided apart from the CPU, and an arrangement may be made that the plurality of ASICs shares and executes various processing.

Computer programs for the CPU to control various operations are stored in the ROM. The RAM is to be used as a storage area for recording temporarily, data and signals etc. to be used at the time when the CPU executes a computer program, or a working area for data processing. Settings and flags etc. that are to be held even after the power supply has been put OFF are stored in the EEPROM.

The motor 78, the carriage motor 153, and various sensors (not depicted in diagrams) are connected to the control section 152. The control section 152 controls the rotation of the motor 78 and the carriage motor 153. Moreover, detection signals from various sensors are sent to the control section 152. The control section 152 computes a position of the end of the recording paper conveyed through the conveying path, based on a detection signal from a sensor which is provided to the conveying path 65 and detects the end of the recording paper, and a detection signal from a rotary encoder which is provided to the first conveyance roller 60. Moreover, the control section 152 computes a position of the carriage 40 based on a detection signal from a linear encoder which is provided along a direction of movement of the carriage 40.

[Image Recording Operation]

An image recording operation by the printer section 11 will be described below.

Figure 18:
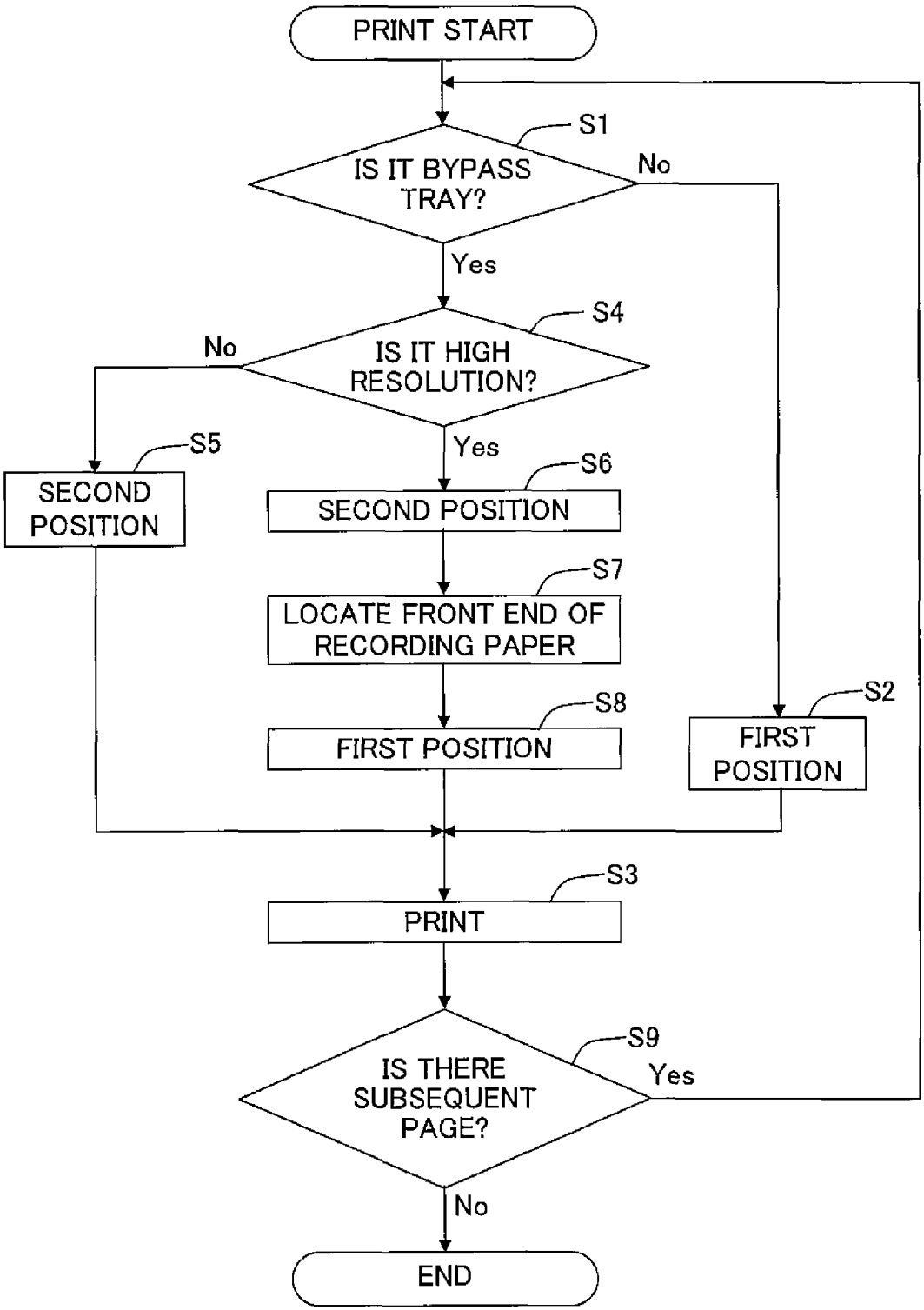
FIG. 18 is a flowchart showing an operation of a printer section 11.

As depicted in FIG. 18, as the control section 152 receives an instruction for starting printing, the control section 152 makes a judgment as to from which one of the feeding tray 20 and the bypass tray the recording paper is to be fed, based on print data that has been received (step S1). If the print data is data giving an instruction for feeding from the feeding tray 20 (No at step S1), the control section 152 moves the carriage 40 by driving the carriage motor 153, and makes the carriage 40 contact with the contact lever 176 of the drive switching section 133. A position of the contact lever 176 is determined according to a moving position of the carriage 40. The control section 152 moves the carriage 40 such that, the contact lever 176 brings the switching gear 171 to a position which is let to be a first engaging position (step S2). Thereafter, the control section 152, by driving the motor 78, drives the feeding roller 25, and feeds a recording paper from the feeding tray 20 to the conveying path 65. Moreover, the control section 152 drives the first conveyance roller 60, the second conveyance roller 62, and the recording section 24, and carries out printing on the recording paper (step S3). After one page has been printed, the control section 152 carries out printing of the subsequent page if data for the subsequent page is available (Yes at step S9). If the data for the subsequent page is not available, the control section 152 terminates the printing (No at step S9).

If the print data is data which gives an instruction for feeding from the bypass tray 71 (Yes at step S1), next, the control section 152 makes a judgment of whether the print data is of a high-resolution mode (second mode). The high-resolution mode is an image recording mode of recording an image with a comparatively higher resolution which is preferable for printing photographs. A low-resolution mode (first mode) in which the resolution is lower than the resolution in the high-resolution mode, has been set as a default in the control section 152. The low-resolution mode is an image recording mode of recording an image with a comparatively lower resolution which is sufficient for printing characters etc. However, these resolutions are relative resolutions. The printer section 11 may have another image recording mode in addition to the low-resolution mode and the high-resolution mode.

When the control section 152 has made a judgment that the print data is not of the high-resolution mode (No at step S4), the control section 152 drives the carriage motor 153, and moves the carriage 40 such that, the contact lever 176 brings the switching gear 171 to a position which is let to be a second engaging position (step S5). Thereafter, the control section 152, by driving the motor 78, drives the moving member 64 and the feeding roller 75, and feeds the recording paper from the bypass tray 71 to the conveying path 65. Moreover, the control section 152 drives the first conveyance roller 60, the second conveyance roller 62, and the recording section 24, and carries out printing on the recording paper in the low-resolution mode (step S3). After one page has been printed, the control section 152 carries out printing of the subsequent page if data for the subsequent page is available (Yes at step S9). If the data for the subsequent page is not available, the control section 152 terminates the printing (No at step S9).

When the control section 152 has made a judgment that the print data is of the high-resolution mode (Yes at step S4), the control section 152 drives the carriage motor 153, and moves the carriage 40 such that, the contact lever 176 brings the switching gear 171 to a position which is let to be the second position (step S6). Thereafter, the control section 152, by driving the motor 78, drives the moving member 64 and the feeding roller 75, and feeds the recording paper from the bypass tray 71 to the conveying path 65. Moreover, the control section 152 carries out locating of the front end of the paper till a position at which the image recording is to be started on the recording paper fed is positioned directly beneath the recording head 39 (step S7). After the sensor provided to the conveying path from the feeding roller 75 up to the first conveyance roller 60 for instance, has detected the front end of the recording paper, the control section 152 is capable of computing the position of the front end of the recording paper from an amount of rotation of the feeding roller 75 or an amount of rotation of the first conveyance roller 60.

After the front end of the recording paper has been located, the control section 152 drives the carriage motor 153 and moves the carriage 40 such that, the contact lever 176 brings the switching gear 171 to a position which is let to be the first position (step S8). Moreover, the control section 152 drives the first conveyance roller 60, the second conveyance roller 62, and the recording section 24, and carries out printing on the recording paper in the high-resolution mode (step S3). After one page has been printed, the control section 152 carries out printing of the subsequent page if data for the subsequent page is available (Yes at step S9). If the data for the subsequent page is not available, the control section 152 terminates the printing (No at step S9).

Here, a rotating torque (first load) which is necessary for the motor 78 for rotating the first conveyance roller 60 when the switching gear 171 is at the first engaging position and a rotating torque (second load) which is necessary for the motor 78 for rotating the first conveyance roller 60 when the switching gear 171 is at the second engaging position are to be compared. Although the switching gear 171 at the first engaging position, by being engaged with the idle gear 139, is in a state of being capable of transmitting the drive to the feeding roller 25, when the first conveyance roller 60 conveys the recording paper in the conveying direction, the transmission of the drive to the feeding roller 25 is cut off by the one-way clutch. Consequently, the rotating torque which is necessary for the motor 78 for rotating the idle gear 139 is sufficiently smaller as compared to the rotating torque which is necessary for rotating the first conveyance roller 60.

The switching gear 171 at the second position, by being engaged with the idle gear 140, is in a state of being capable of transmitting the drive to the moving member 64, the feeding roller 75, and the pivot member 30. When the first conveyance roller 60 conveys the recording paper in the conveying direction, the rotational driving force is transmitted to the moving member 64 from the motor 78, and the moving member 64 moves from the retracted position to the projected position. Thereafter, the rotation of the gear 77B slips due to the torque limiter 127, and is not transmitted to the pivot shaft 66. Moreover, the pivot member 30 moves from the fourth position to the third position, and thereafter, the rotation of the gear 49 slips due to the torque limiter 32, and is not transmitted to the pivot body 91.

In a state of the drive not being transmitted due to the torque limiters 32 and 127, since the gear 77*b* and the gear 49 are rotating resisting the friction generated in the torque limiters 32 and 127, the rotating torque which is necessary for the motor 78 for rotating the idle gear 139 is a rotating torque necessary for making torque limiter 32 slip by resisting the friction in addition to the rotating torque which is necessary for rotating the first conveyance roller 60. Consequently, the rotating torque (first load) which is necessary for the motor 78 for rotating the conveyance roller 60 when the switching gear 171 is at the first engaging position is smaller as compared to the rotating torque (second load) which is necessary for the motor 78 for rotating the first conveyance roller 60 when the switching gear 171 is at the second engaging position (first load<second load).

As aforementioned, the control section 152, after completing locating the front end of the recording paper, moves the carriage 40 by driving the carriage motor 153, such that the contact lever 176 brings the switching gear 171 to a position which is let to be the first position (step S8), and carries out printing on the recording paper in the high-resolution mode by driving the first conveyance roller 60, the second conveyance roller 62, and the recording section 24 (step S3). Therefore, the rotating torque required by the motor 78 after locating the front end of the recording paper is small.

[Effect of Present Embodiment]

According to the present embodiment, since the first conveyance roller 60 is driven letting the switching gear 171 to be (at) the first engaging position where the load is smaller than at the second engaging position, after the recording paper is fed in the feeding direction 87 from the bypass tray 71 and conveyed to the first conveyance roller 60 by transmitting the drive from the motor 78 to the moving member 64, the conveyance roller 75, and the pivot member 30 by the switching gear 171 at the second position, the load on the motor 78 while conveying the recording paper through the conveying path is reduced.

Moreover, when the moving member 64 is at the projected position, the recording paper supported by the bypass tray 71 is restrained from moving in the feeding direction 87. When the moving member 64 is at the retracted position, the feeding roller 75 rotates and the recording paper supported by the bypass tray 71 is fed in the feeding direction 87.

Since the movement of the contact member 117 of the moving member 64 is regulated at the retracted position by regulating the movement of the sliding member 116 by the sliding member 116 being contacted with the first side surface 122, and the movement of the contact member 117 of the moving member 64 is reregulated by regulating the movement of the sliding member 116 by the sliding member 116 being contacted with the second side surface 123, the moving member 64 is held at the projected position or the retracted position while the rotational drive is transmitted to the feeding roller 75 continuously.

Moreover, the control section 152, at the time of carrying out image recording in the high-resolution mode, conveys the recording paper by the first conveyance roller 60 letting the switching gear 171 to be at the first engaging position, after locating the front end of the recording paper upon feeding the recording paper from the bypass tray 71 letting the switching gear 171 to be at the second engaging position. Moreover, the control section 152, at the time of carrying out image recording in the low-resolution mode, carries out printing upon feeding the recording paper from the bypass tray 71 letting the switching gear 171 to be at the second engaging position as it has been. Therefore, when the resolution of an image recorded is low and the time required for image recording is comparatively shorter, it is possible to complete the image recording early without moving the switching gear 171. On the other hand, when the resolution of the image recorded is high and the time required for image recording is comparatively longer, it is possible to reduce the load on the motor 78.

According to the present embodiment, it is possible to move the contact lever 176 by moving the carriage 40. Accordingly, the contact lever 176 moves to any one of a position of holding the switching gear 171 at the first engaging position and a position of holding the switching gear 171 at the second engaging position. In the present embodiment, a width of the switching gear 171 (a length of the switching gear 171 in the scanning direction) is larger than a gap in the scanning direction between the idle gear 139 and the idle gear 140. In the present embodiment, it is not possible to locate the switching gear 171 outside of the idle gears 139 and 140 in the scanning direction. Therefore, in the present embodiment, the switching gear 171 is held at any one of the first engaging position and the second engaging position all the time. As depicted in FIG. 19, the contact lever 176 may be arranged to move to a position of holding the switching gear 171 at a third engaging position which is different from the first engaging position and the second engaging position. In this case, the switching gear 171 is held at any one of the first engaging position, the second engaging position, and the third engaging position all the time.

When the switching gear 171 is at the first engaging position, the driving force of the motor 78 is transmitted to the feeding roller 25 via the idle gear 139, the drive transmission mechanism 27 and the like. As aforementioned, the drive transmission mechanism 27 is provided with the one-way clutch. By the one-way clutch, one of the normal rotation and the reverse rotation of the motor 78 is transmitted to the feeding roller 25, and the remaining of the normal rotation and the reverse rotation of the motor 78 is not transmitted to the feeding roller 25. For example, it is possible to make an arrangement such that, when the motor 78 rotates in the normal direction, the feeding roller 25 spins freely, and when the motor 78 rotates in the reverse direction, the feeding roller 25 rotates in a direction of feeding the recording paper.

When the switching gear 171 is at the second engaging position, as aforementioned, if the motor rotates in the normal direction, the rotational driving force of the normal rotation of the motor 78 is transmitted to the feeding roller 75 via the idle gear 140, the second drive transmission section 36 and the like. The rotational driving force of the normal rotation of the motor 78 is transmitted also to the pivot member 30 via the idle gear 140, the second drive transmission section 36, the torque limiter 32, and the like. Furthermore, the rotational driving force of the normal rotation of the motor 78 is transmitted also to the moving member 64 via the third drive transmission section 37. By the rotational driving force of the normal rotation of the motor 78 being transmitted, the feeding roller 75 rotates in a direction of feeding the recording paper, and the pivot member 30 is pivoted from the third position to the fourth position such that the roller 92 is separated apart from the recording paper. Furthermore, the contact member 117 of the moving member 64 moves from the projected position to the retracted position.

When the switching gear 171 is at the second engaging position, as aforementioned, if the motor rotates in the reverse direction, the rotational driving force of the reverse rotation of the motor 78 is transmitted to the feeding roller 75 via the idle gear 140, the second drive transmission section 36 and the like. Moreover, the rotational driving force of the reverse rotation of the motor 78 is transmitted also to the pivot member 30 via the second drive transmission section 36 and the torque limiter 32. Furthermore, the rotational driving force of the reverse rotation of the motor 78 is transmitted also to the moving member 64 via the third drive transmission section 37. By the rotational driving force of the reverse rotation of the motor 78 being transmitted, the feeding roller 75 rotates in a direction of feeding the recording paper in the reverse direction. Moreover, the pivot member 30 is pivoted in a direction directed from the second position toward the first position, such that the roller 92 contacts with the recording paper and lifts the feeding roller 75 up. Furthermore, by the rotational driving force of the reverse rotation of the motor 78 being transmitted to the moving member 64, the contact member 117 of the moving member 64 moves from the retracted position toward the projected position.

Specifically, when the motor 78 rotates in the normal direction, the roller 92 contacts with the recoding paper and the feeding roller 75 is separated from the recording paper. When the motor 78 rotates in the reverse direction, the roller 92 is separated from the recording paper and the feeding roller 75 contacts with the recording paper. When the motor 78 rotates in the reverse direction to let the feeding roller 75 convey the recoding paper, the first conveyance roller 60 rotates in the reverse direction. Therefore, even when the recording paper arrives at the first conveyance roller 60, the recording paper can not be transported beyond the first conveyance roller 60. After the motor 78 rotates in the normal direction to rotate the first conveyance roller 60 in the normal direction, the recording paper is conveyed beyond the first conveyance roller 60. At the moment when the first conveyance roller begins to rotate, the feeding roller 75 begins to separate from the recording paper. Therefore, in this case, the recording paper is pulled by the first conveyance roller 60 and the feeding roller 75. However, when the recording paper is conveyed to the first conveyance roller 60 by the feeding roller 75, the recording paper is a little curled. Therefore, even when the recording paper is pulled by the first conveyance roller 60 and the feeding roller 75, there is no problem. In the description as described above, when the motor 78 is rotated in the normal direction, the first conveyance roller is rotated to convey the recording paper toward the recording head 39 to perform printing. However, the configuration of the conveyance unit is not restricted to such a configuration. Contrary to the above description, the first conveyance roller can be configured to be rotated to convey the recording paper toward the recording head 39 to perform printing, when the motor 78 is rotated in the reverse direction.

When the switching gear 171 is at the third engaging position, the switching gear 171 may get engaged with a gear 210, and the rotational driving force of the motor 78 may be transmitted to a maintenance mechanism 200 via the gear 210. For instance, the maintenance mechanism 200 may include a suction pump 201 which is used for flushing, and a cam mechanism for maintenance 202 which moves a wiper mechanism not depicted in the diagram up and down. It is possible to make an arrangement such that, at this time, the rotational driving force of the normal rotation of the motor 78 is transmitted to the suction pump 201 via the gear 210, and the rotational driving force of the reverse rotation of the motor 78 is transmitted to the cam mechanism for maintenance 202 via the gear 210.

[Modification]

In the aforementioned embodiment, in the high-resolution mode, the recording paper is conveyed by the first conveyance roller 60 letting the switching gear to be (at) the first position after the locating of the front end is carried out upon feeding the recording paper from the bypass tray 71 letting the switching gear 171 to be (at) the second position from image recording of the first page. However, an arrangement may be made such that, for the number of pages from the second page up to the $N^{th}$ page on which the image recording is to be carried out, printing may be carried out upon feeding the recording paper from the bypass tray letting the switching gear 171 to be at the second position as it has been. From the $N^{th}$ page onward, after locating the front end of the recording paper upon feeding the recording paper from the bypass tray 171 letting the switching gear 171 to be (at) the second position, the recording paper may be conveyed by the first conveyance roller 60 letting the switching gear 171 to be the first position. In such control, when the control unit 152 has to make a judgment of whether there is going to be image recording of the subsequent page (step S9), a control of counting in order to know if the number of pages subjected to image recording is N or more than N, is to be carried out.

Accordingly, when the number of recording papers on which image recording is to be carried out is comparatively smaller, and the load on the motor 78 is not susceptible to be excessive, it is possible to complete the image recording fast without moving the switching gear 171 from the second position to the first position. On the other hand, when the number of recording papers on which image recording is to be carried out is comparatively larger, and the load on the motor is susceptible to be excessive, it is possible to reduce the load on the motor 78.

From the $N^{th}$ page onward as in the modified example, after the front end of the recording paper has been located upon feeding the recording paper from the bypass tray 71 letting the switching gear 171 to be at the second position, the control of conveying the recording paper by the first conveyance roller 60 letting the switching gear 171 to be at the first position is not restricted to be carried out in the high-resolution mode, and may be carried out in the low-resolution mode. In other words, the movement of the switching gear 171 (whether the switching gear 171 is to be moved or not) according to the resolution mode in the aforementioned embodiment is not required to be carried out necessarily, and the switching gear 171 may be moved from the second position to the first position in all the modes of feeding the recording paper from the bypass tray 71.

Moreover, in the aforementioned embodiment, after the front end of the recording paper has been located upon feeding the recording paper from the bypass tray letting the switching gear 171 to be at the second position, the recording paper is conveyed by the first conveyance roller 60 letting the switching gear 171 to be at the first position. However, the front end of the recording paper need not be located necessarily provided that the recording paper is in a state in which the recording paper can be conveyed by the first conveyance roller 60. Consequently, in a state in which the front end of the recording paper is nipped between the pair of first conveyance rollers 59, but the front end of the recording paper has not yet reached directly beneath the recording head 39, the recording paper may be conveyed by the first conveyance roller 60 letting the switching gear 171 at the second position to be at the first position.

Moreover, in the aforementioned embodiment, the drive from the motor 78 is transmitted to the moving member 64, the conveyance roller 75, and the pivot member 30 from the switching gear 171 at the second position. The components here is an example of the feeding section, and a structure of the feeding section may be changed appropriately. Moreover, from the switching gear 171 at the first position, the drive is transmitted to the feeding roller 25. However, the drive may be transmitted to a drive section other than the feeding roller 25. In other words, if the load for driving the first conveyance roller 60 when the switching gear 171 is let to be at the first position is smaller than the load for driving the first conveyance roller 60 when the switching gear 171 is let to at the second position, the switching gear 171 at the first position may transmit the drive to a drive section other than the feeding roller 25, such as an automatic document feeder (ADF) in a scanner.

Moreover, the number of gears in the drive switching section 133, the main-body side drive transmission section 134, the first drive transmission section 35, the second drive transmission section 36, and the third drive transmission section 37 may be changed appropriately. Further, the conveyance unit does not necessarily include the switching gear 171 as described above. For example, the conveyance unit may include a planetary gear which is configured to switch the rotational driving force of the motor 78 among the idle gear 139, the idle gear 140 and the gear 210, in place of the switching gear 171.

Moreover, the conveyance unit is not restricted to the printer section 11, and the conveyance unit may be realized as a scanner which conveys a sheet and reads or scans an image.

What is claimed is:

1. A conveyance apparatus configured to convey a sheet, comprising:

a drive source configured to generate a driving force;

a conveyance roller configured to rotate in a conveying direction by the driving force from the drive source;

a conveying gear provided coaxially to the conveyance roller to rotate with the conveyance roller as a unit;

a switching gear engaged with the conveying gear, the switching gear being configured to move to one of a first position and a second position with respect to the conveying gear, the second position being different from the first position in an axial direction of the conveying gear;

a switching section configured to move the switching gear to the first position and the second position;

a supporting section configured to support the sheet;

a feeding section configured to feed the sheet supported by the supporting section in a first feeding direction;

a drive section configured to be driven by the driving force from the drive source;

a first gear engaged with the switching gear in the first position, and configured to transmit the driving force to the drive section;

a second gear engaged with the switching gear in the second position, and configured to transmit the driving force to the feeding section, and a controller configured to control an operation of the drive source and the switching section, wherein a first load on the drive source for rotating the conveyance roller in the conveying direction under a condition that the switching gear is at the first position is smaller than a second load on the drive source for rotating the conveyance roller in the conveying direction under a condition the switching gear is at the second position, and the operation of the controller includes a conveying mode in which the switching gear is let to be at the second position by driving the switching section, and after driving the drive source till the sheet reaches the conveyance roller from the supporting section and is conveyed by the conveyance roller, the controller drives the drive source upon letting the switching gear to be at the first position by driving the switching section, and makes the conveyance roller convey the sheet;

wherein the feeding unit includes:

a first feeding roller configured to feed the sheet supported by the supporting section in the first feeding direction, an arm configured to rotatably support the first feeding roller at one end portion, the arm being pivotable with the other end portion as a pivot shaft, a guide provided to a downstream side of the supporting section in the first feeding direction, and the guide including a sheet contacting surface configured to guide the sheet upon contacting with the sheet fed in the first feeding direction, and a moving member provided to the guide, and being movable to a projected position, which is projected from the sheet contacting surface and which is contactable with the sheet fed in the first feeding direction, and to a retracted position, which is retracted from the sheet contacting surface and which includes a stopping surface configured to stop the sheet by contacting with the sheet, and wherein the driving force is transmitted to the first feeding roller and the moving member via the second gear.

2. The conveyance apparatus according to claim 1, wherein the feeding section includes:

a projected regulating portion contacting with the moving member, and configured to regulate the movement of the moving member at the projected position, a refracted regulating portion contacting with the moving member, and configured to regulate the movement of the moving member at the refracted position, and a torque limiter configured to cut off the driving force from the second gear as the movement of the moving member is regulated by the projected regulating portion or the retracted regulating portion.

3. The conveyance apparatus according to claim 1, wherein the conveyance roller is configured such that even when the switching gear is at any of the first position and the second position, the driving force is transmitted from the drive source.

4. The conveyance apparatus according to claim 2, further comprising:

a tray provided independently of the supporting section, and being configured to place the sheet thereon, wherein the drive section includes a second feeding roller configured to feed the sheet placed in the tray in a second direction.

5. The conveyance apparatus according to claim 1, wherein the switching gear is configured to be located at only the first position or the second position.

6. An image recording apparatus comprising:

the conveyance apparatus according to claim 1; and a recording section configured to record an image on a sheet conveyed by the conveyance roller.

7. The image recording apparatus according to claim 6, wherein the recording section includes a carriage configured to move in a main scanning direction, which intersects the conveying direction and which is parallel to an axis of the conveyance roller, and a recording head installed on the carriage, and the switching gear is movable in the main scanning direction, and the switching section includes a switching lever configured to contact with the switching gear from the main scanning direction, and move the switching gear to the first position and the second position, and the switching lever moves the switching gear by moving in the main scanning direction by the carriage being contacted.

8. The image recording apparatus according to claim 6, wherein the controller is configured to control the recording section to perform image recording, and the controller includes a first mode, and a second mode in which a resolution of an image recorded is higher than a resolution of an image recorded in the first mode, and at the time of carrying out image recording in the second mode, the controller is configured to select a transporting mode, and at the time of carrying out image recording in the first mode, the controller is configured to drive the feeding section and the conveyance roller, letting the switching gear to be at the second position as it has been, by driving the switching section.

9. The image recording apparatus according to claim 6, wherein the switching gear is configured to move to a third position which is different from the first position and the second position, and the switching section is configured to move the switching gear to one of the first position, the second position, and the third position, and the recording section further includes a maintenance mechanism configured to carry out maintenance of a recording head, and the conveyance apparatus further includes a third gear engaged with the switching gear at the third position, and configured to transmit the driving force to the maintenance mechanism.

10. An image recording apparatus comprising:

a conveyance apparatus configured to convey a sheet, comprising:

a drive source configured to generate a driving force;

a conveyance roller configured to rotate in a conveying direction by the driving force from the drive source;

a conveying gear provided coaxially to the conveyance roller to rotate with the conveyance roller as a unit;

a switching gear engaged with the conveying gear, the switching gear being configured to move to one of a first position and a second position with respect to the conveying gear, the second position being different from the first position in an axial direction of the conveying gear;

a switching section configured to move the switching gear to the first position and the second position;

a supporting section configured to support the sheet;

a feeding section configured to feed the sheet supported by the supporting section in a first feeding direction;

a drive section configured to be driven by the driving force from the drive source;

a first gear engaged with the switching gear in the first position, and configured to transmit the driving force to the drive section;

a second gear engaged with the switching gear in the second position, and configured to transmit the driving force to the feeding section, and a controller configured to control an operation of the drive source and the switching section, wherein a first load on the drive source for rotating the conveyance roller in the conveying direction under a condition that the switching gear is at the first position is smaller than a second load on the drive source for rotating the conveyance roller in the conveying direction under a condition the switching gear is at the second position, and wherein the operation of the controller includes a conveying mode in which the switching gear is let to be at the second position by driving the switching section, and after driving the drive source till the sheet reaches the conveyance roller from the supporting section and is conveyed by the conveyance roller, the controller drives the drive source upon letting the switching gear to be at the first position by driving the switching section, and makes the conveyance roller convey the sheet, and a recording unit configured to record an image on a sheet conveyed by the conveyance roller, wherein the recording unit includes a carriage configured to move in a main scanning direction, which intersects the conveying direction and which is parallel to an axis of the conveyance roller, and a recording head installed on the carriage, wherein the switching gear is movable in the main scanning direction, wherein the switching section includes a switching lever configured to contact with the switching gear from the main scanning direction, and move the switching gear to the first position and the second position, wherein the switching lever moves the switching gear by moving in the main scanning direction by the carriage being contacted, and wherein the image recording apparatus further comprises a holding section which includes a hole formed therein, a first engaging portion which is located around the hole such that the first engaging portion is engaged with the switching lever at the first position, and a second engaging portion which is located around the hole such that the second engaging portion is engaged with the switching lever at the second position, wherein a length of the hole in the main scanning direction defines a maximum movable range of the switching gear in the main scanning direction, and wherein a gap between the first gear and the second gear in the axial direction is smaller than a width of the switching gear in the axial direction.

11. A image recording apparatus comprising:

a conveyance apparatus configured to convey a sheet, comprising:

a drive source configured to generate a driving force;

a conveyance roller configured to rotate in a conveying direction by the driving force from the drive source;

a conveying gear provided coaxially to the conveyance roller to rotate with the conveyance roller as a unit;

a switching gear engaged with the conveying gear, the switching gear being configured to move to one of a first position and a second position with respect to the conveying gear, the second position being different from the first position in an axial direction of the conveying gear;

a switching section configured to move the switching gear to the first position and the second position;

a supporting section configured to support the sheet;

a feeding section configured to feed the sheet supported by the supporting section in a first feeding direction;

a drive section configured to be driven by the driving force from the drive source;

a first gear engaged with the switching gear in the first position, and configured to transmit the driving force to the drive section;

a second gear engaged with the switching gear in the second position, and configured to transmit the driving force to the feeding section, and a controller configured to control an operation of the drive source and the switching section, wherein a first load on the drive source for rotating the conveyance roller in the conveying direction under a condition that the switching gear is at the first position is smaller than a second load on the drive source for rotating the conveyance roller in the conveying direction under a condition the switching gear is at the second position, and wherein the operation of the controller includes a conveying mode in which the switching gear is let to be at the second position by driving the switching section, and after driving the drive source till the sheet reaches the conveyance roller from the supporting section and is conveyed by the conveyance roller, the controller drives the drive source upon letting the switching gear to be at the first position by driving the switching section, and makes the conveyance roller convey the sheet, and a recording section configured to record an image on a sheet conveyed by the conveyance roller, wherein the controller is configured to control the recording section to perform image recording, wherein the controller is configured to count a number of sheets on which the image recording is carried out by the recording section, and wherein the controller is configured to:

drive the feeding section and the conveyance roller by letting the switching gear to be at the second position as it has been, by driving the switching section, till counting N number of sheets where, N is a natural number greater than 1, which has been set in advance, and select the conveying mode after counting N number of sheets.

12. An image recording apparatus comprising:

a conveyance apparatus configured to convey a sheet, comprising:

a drive source configured to generate a driving force;

a conveyance roller configured to rotate in a conveying direction by the driving force from the drive source;

a conveying gear provided coaxially to the conveyance roller to rotate with the conveyance roller as a unit;

a switching gear engaged with the conveying gear, the switching gear being configured to move to one of a first position and a second position with respect to the conveying gear, the second position being different from the first position in an axial direction of the conveying gear;

a switching section configured to move the switching gear to the first position and the second position;

a supporting section configured to support the sheet;

a feeding section configured to feed the sheet supported by the supporting section in a first feeding direction;

a drive section configured to be driven by the driving force from the drive source;

a first gear engaged with the switching gear in the first position, and configured to transmit the driving force to the drive section;

a second gear engaged with the switching gear in the second position, and configured to transmit the driving force to the feeding section, and a controller configured to control an operation of the drive source and the switching section, wherein a first load on the drive source for rotating the conveyance roller in the conveying direction under a condition that the switching gear is at the first position is smaller than a second load on the drive source for rotating the conveyance roller in the conveying direction under a condition the switching gear is at the second position, and wherein the operation of the controller includes a conveying mode in which the switching gear is let to be at the second position by driving the switching section, and after driving the drive source till the sheet reaches the conveyance roller from the supporting section and is conveyed by the conveyance roller, the controller drives the drive source upon letting the switching gear to be at the first position by driving the switching section, and makes the conveyance roller convey the sheet, and a recording section configured to record an image on a sheet conveyed by the conveyance roller, wherein the switching gear is configured to move to a third position which is different from the first position and the second position, wherein the switching section is configured to move the switching gear to one of the first position, the second position, and the third position, wherein the recording section further includes a maintenance mechanism configured to carry out maintenance of a recording head, wherein the conveyance apparatus further includes a third gear engaged with the switching gear at the third position, and configured to transmit the driving force to the maintenance mechanism, and wherein the switching gear is configured to be located at any one of the first position, the second position, and the third position all the time.

* * * * *